US006831600B1

(12) United States Patent
Cherrette et al.

(10) Patent No.: US 6,831,600 B1
(45) Date of Patent: Dec. 14, 2004

(54) INTERMODULATION SUPPRESSION FOR TRANSMIT ACTIVE PHASED ARRAY MULTIBEAM ANTENNAS WITH SHAPED BEAMS

(75) Inventors: Alan Cherrette, Hermosa Beach, CA (US); Erik Lier, Newtown, PA (US); Bryan Cleaveland, Baldwinsville, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 10/806,776

(22) Filed: Mar. 23, 2004

Related U.S. Application Data

(60) Provisional application No. 60/498,333, filed on Aug. 26, 2003.

(51) Int. Cl.[7] ..... H01Q 3/26

(52) U.S. Cl. ..... 342/373; 342/368; 342/372; 455/202

(58) Field of Search ..... 342/81, 154, 368, 342/371, 372, 373; 455/67.11, 202, 203, 450

(56) References Cited

U.S. PATENT DOCUMENTS 3,877,012 A * 4/1975 Nelson ..... 342/371
4,673,942 A * 6/1987 Yokoyama ..... 342/368
5,204,686 A 4/1993 Petrelis et al.
5,548,813 A 8/1996 Charas et al.
5,550,550 A 8/1996 Das
5,555,257 A 9/1996 Dent
5,619,503 A 4/1997 Dent
5,736,963 A * 4/1998 Roederer et al. ..... 342/373
5,959,579 A 9/1999 Gladh
5,966,048 A 10/1999 Thompson
6,239,657 B1 * 5/2001 Bauer ..... 330/149
6,377,558 B1 4/2002 Dent
6,472,947 B1 10/2002 Zeitz
6,473,453 B1 10/2002 Wilkinson
2004/0023657 A1 * 2/2004 Lim ..... 455/446

* cited by examiner

*Primary Examiner*—Dao Phan
(74) *Attorney, Agent, or Firm*—McDermott Will & Emery LLP

(57) ABSTRACT

Methods and apparatus are provided for determining aperture phase distributions for use in radiating signals with an active phased array antenna having multiple beams and multiple carriers. Distinct initial phase distributions corresponding to the carriers are allocated. The initial phase distributions are modified for each of the carriers to generate respective radiation patterns that substantially correspond to respective coverage areas in accordance with amplification and radiation of signals having the initial phase distributions. The modified phase distributions are optimized to simultaneously increase carrier-signal power and reduce an intermodulation product radiated in the respective coverage areas in accordance with amplification and radiation of signals having the modified phase distributions.

35 Claims, 17 Drawing Sheets

Ku-Band

Active array, 16x16 alam. alcm size = 3.0 lamda
EIRP-Optimized Pattern with Paraboloidal-Type Phase
Relative Pattern

Ku-Band

Active array, 16x16 alam. alcm size = 3.0 lamda
EIRP-Optimized Pattern with Saddle-Type Phase
Relative Pattern

Ku-Band

Active array, 16x16 alam. alcm size = 3.0 lamda
EIRP-Optimized Pattern with Paraboloidal-Type Phase
C/13 Pattern, Minimum = 11.5dB

Ku-Band

Active array, 16x16 alam. alcm size = 3.0 lamda
EIRP-Optimized Pattern with Saddle-Type Phase
C/13 Pattern, Minimum = 12.0dB

Ku-Band

Active array, 16x16 alam. alcm size = 3.0 lamda
EIRP-Optimized Pattern with Saddle-Type Phase
Relative Pattern, EIRP Reduction due to IM-Opi = 0.17 dB

Ku-Band

Active array, 16x16 alam. alcm size = 3.0 lamda
EIRP & IM Optimized Pattern with Saddle-Type Phase
$C/I_3$ Pattern, Minimum = 23.4dB, EIRP Reduction = 0.17db

Ku-Band

Active array, 16x16 alam. alcm size = 3.0 lamda
EIRP & IM Optimized Pattern with Saddle-Type Phase
$C/I_5$ Pattern, Minimum = 27.4dB, EIRP Reduction = 0.17db

INTERMODULATION SUPPRESSION FOR TRANSMIT ACTIVE PHASED ARRAY MULTIBEAM ANTENNAS WITH SHAPED BEAMS

CROSS REFERENCE TO RELATED APPLICATION

This application is a nonprovisional of, and claims the benefit of the filing date of, U.S. Prov. Pat. Appl. No. 60/498,333, entitled "INTERMODULATION SUPPRESSION FOR ACTIVE PHASED ARRAY MULTIBEAM ANTENNAS WITH SHAPED BEAMS," filed Aug. 26, 2003 by Erik Lier et al., the entire disclosure of which is incorporated herein by reference for all purposes.

BACKGROUND OF THE INVENTION

This application relates generally to transmit active phased array antennas with multiple shaped beams. More specifically, this application relates to suppression of intermodulation-product peak value radiated from active phased array antennas over a coverage area.

Active phased array antennas are generally suitable for applications in which multiple high-directivity beams are to be generated with large signal bandwidth, as may be appropriate for broadband applications such as multimedia and video conferencing. The suitability of active phased array antennas for such applications derives from the fact that they may be configured in orbit to provide bandwidth on demand anywhere within an identified service area, and thereby maximize the overall system utilization. Furthermore, active phased array antennas with phase shifters enable a variety of different types of beam characteristics. For example, such antennas may support configurations that correspond to one or a few channels per beam, shaped beams, scanned beams, and beams that are reconfigurable with respect to shape, beam direction, frequency, and power.

A particular challenge for these types of systems is to optimize the payload capacity under the constraint of meeting certain performance requirements. Because of cost and size considerations, transmit active phased array antennas typically use solid-state power amplifiers ("SSPA"), which are operated in a linear region at wide bandwidth to accommodate the fact that each element amplifier may see all carriers in a signal. Such operational parameters result in a low power-conversion efficiency, i.e. of the order of 20%. Accordingly, the high power subsystem weight and thermal-dissipation needs of such SSPAs tend to drive the cost of the payload. Increases in efficiency of the use of SSPAs in active phased array antennas may thus have a significant impact on the overall cost of a spacecraft that carries the antenna.

A particular limiting factor in the efficiency of SSPAs in active phased array antennas is the power associated with production of intermodulation products. As an SSPA is driven into a more efficient nonlinear region, power is transferred from the carriers into intermodulation products, and those intermodulation products that fall in the carrier bands degrade the signal-to-noise level. One approach that is sometimes taken to reduce the strength of intermodulation products is to back off the power of the SSPAs by about 2–3 dB, although such an approach further compromises the overall efficiency of the SSPAs.

There is accordingly a general need in the art for suppressing intermodulation products for active phased array antennas.

BRIEF SUMMARY OF THE INVENTION

Embodiments of the invention thus provide a method for determining phase distributions for use in transmitting signals with an active phased array antenna having a plurality of beams and a plurality of carriers. Distinct initial aperture phase distributions corresponding to the plurality of carriers are allocated. The aperture phase distributions are optimized to simultaneously increase carrier-signal power and reduce an intermodulation product radiated in the respective coverage areas in accordance with amplification and radiation of signals having the modified aperture phase distributions. In some embodiments, the initial aperture phase distributions are modified for each of the plurality of carriers to generate respective radiation patterns that substantially correspond to respective coverage areas in accordance with amplification and radiation of signals having the initial aperture phase distributions.

The methods of the invention may support different beam configurations. For example, in some embodiments, the respective coverage areas for the plurality of carriers is substantially the same. Also, embodiments of the invention may make use of different initial aperture phase distributions. In one embodiment, at least one of the initial aperture phase distributions is substantially paraboloidal. In another embodiment, at least one of the initial aperture phase distributions is substantially hyperbolically paraboloidal. A first of the initial aperture phase distributions may have two or more orthogonal planes of symmetry about an axis orthogonal to a first aperture plane and a second of the initial aperture phase distributions may be asymmetric about the axis. In some embodiments, some of the initial aperture phase distributions may advantageously be transforms of each other. For example, in one embodiment, a second of the initial aperture phase distributions is substantially equal to a first of the initial aperture phase distributions subject to complex conjugation and a 180° rotation in an aperture plane.

In various embodiments, the intermodulation product may comprise a third-order intermodulation product, may comprise a fifth-order intermodulation product, and may comprise an in-band intermodulation product.

In some instances, the active phased array antenna may further comprise a second plurality of carriers, with second initial aperture phase distributions corresponding to the second plurality of carriers also allocated. Each such second initial aperture phase distribution is substantially equal to one of the initial aperture phase distributions. The second initial aperture phase distributions are modified for each of the second plurality of carriers to generate respective radiation patterns that substantially correspond to respective coverage areas in accordance with amplification and transmission of signals having the second initial aperture phase distributions. The modified second aperture phase distributions are optimized to simultaneously increase carrier-signal power and reduce an intermodulation product radiated in the respective coverage areas in accordance with amplification and transmission of signals with the modified aperture phase distributions and second modified aperture phase distributions. In one such embodiment, each of the plurality of carriers and the second plurality of carriers is less than five in number.

Embodiments of the invention also include methods for transmitting a plurality of shaped beams with an active phased array antenna having a plurality of carriers. A first of the plurality of shaped beams is transmitted with a first of the plurality of carriers and a second of the plurality of shaped beams is transmitted with a second of the plurality of carriers. The plurality of shaped beams have aperture phase distributions determined as described above.

The methods of the invention may also be embodied by an active phased array antenna. The active phased array antenna has a plurality of antenna elements, a plurality of filter elements coupled with the antenna elements, a plurality of amplifier elements coupled with the antenna elements, and a plurality of shaped beam ports. A beamformer is provided having a plurality of elemental paths for coupling the beam ports with the amplifier elements. The beamformer includes phase shifters adapted to provide aperture phase distributions to the amplifier elements in accordance with the embodiments described above.

BRIEF DESCRIPTION OF THE DRAWINGS

A further understanding of the nature and advantages of the present invention may be realized by reference to the remaining portions of the specification and the drawings wherein like reference numerals are used throughout the several drawings to refer to similar components. In some instances, a sublabel is associated with a reference numeral and is enclosed in parentheses to denote one of multiple similar components. When reference is made to a reference numeral without specification to an existing sublabel, it is intended to refer to all such multiple similar components.

DETAILED DESCRIPTION OF THE INVENTION

Figure 1A:
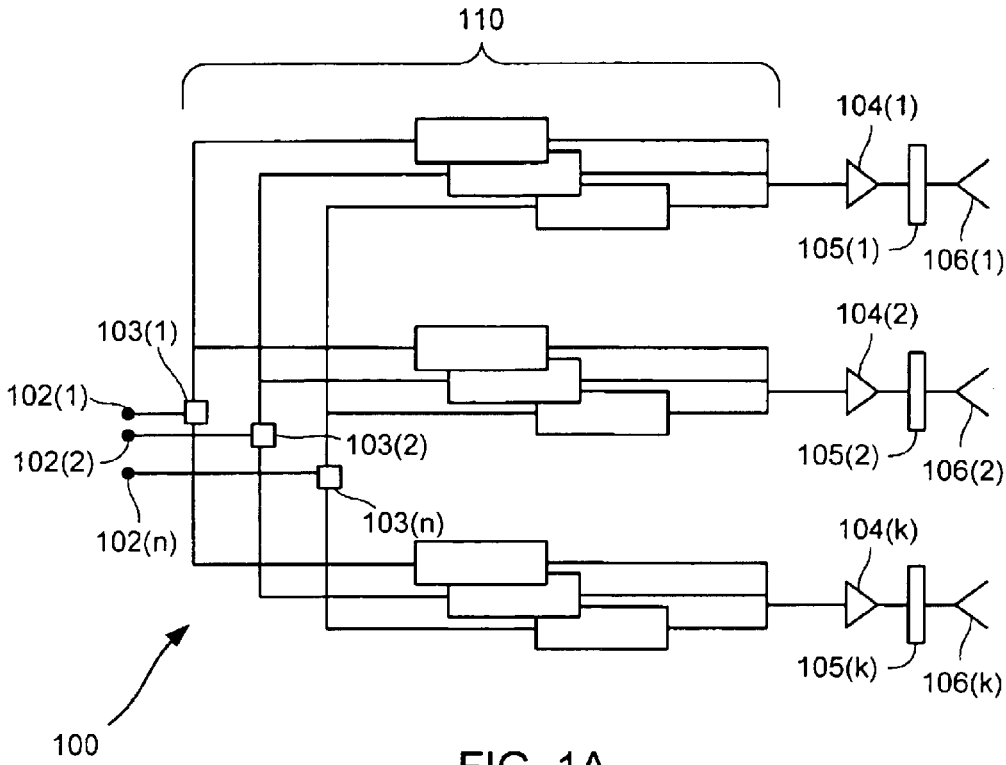
FIG. 1A provides a schematic illustration of a structure for an active phased array antenna.

Embodiments of the invention provide for suppression of a spatial distribution of radiated intermodulation products for shaped electromagnetic contour beams that are propagated to defined coverage areas. This may include a suppression of the peak value of the intermodulation products within the defined coverage areas. The electromagnetic beams may be generated and propagated by an active phased array antenna 100, a schematic structure of which is illustrated for an embodiment in FIG. 1A. The structure provides communication between N channel ports 102 and K antenna elements 106. Such communication is effected by a beamformer 110, which provides communication between the N channel ports and K amplifier elements 104, which are themselves in communication with the antenna elements 106. With such a structure, N beams are split into K paths, with each such path going into a beamformer element that applies a particular attenuation and phase shift. The resulting attenuations and phase shifts shape the beams that are subsequently amplified by the amplifier elements 104 and radiated by the antenna elements 106, thus permitting the active phased array antenna to generate any desired beam shape. In the case of geostationary satellite applications, for example, the defined coverage areas may correspond to coverage areas on the surface of the Earth. As used herein, a "shaped" beam refers to a beam having a size that is larger than a natural beam size that corresponds to uniform amplitude and phase over an aperture of the array.

Figure 1B:
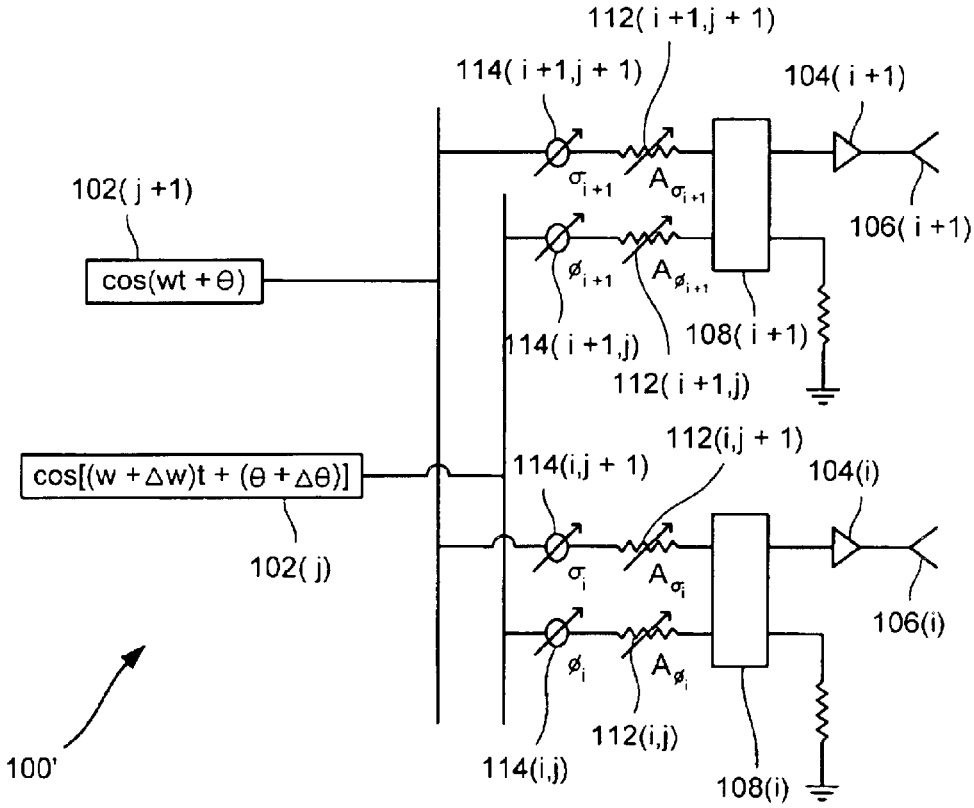
FIG. 1B provides an illustration of a structure for a beamformer comprised by the active phased array antenna shown in FIG. 1A.

FIG. 1B provides a more detailed illustration of the structure of the beamformer for a particular structure for the active phased array antenna 100'. In this embodiment, each beam former element comprises a combiner 108 that is adapted to combine the N signals received for each antenna element 106. The example shown in FIG. 1B uses two channel ports j and j+1 and two antenna elements i and i+1 to illustrate the coupling, although it will be appreciated that j may be equal to 1, 2, . . . , N−1 and i may be equal to 1, 2, . . . , K−1. In addition to the combiner 108, the beamformer elements include variable phase shifters 114 and variable attenuators 112. The beamformer also includes N power dividers 103 to distribute the power from each channel port 102 to each of its phase shifters and attenuators.

In order to illustrate the generation of intermodulation products with such an arrangement, specific phase shifts and attenuation values are denoted in the figure. In particular, $\sigma_i$ and $\sigma_{i+1}$ denote the phase for the ith and (i+1)th antenna elements for the (j+1)th carrier signal and $\phi_i$ and $\phi_{i+1}$ denote the phase for the ith and (i+1)th antenna elements for the jth carrier signal. The signal amplitudes are denoted A, with corresponding subscripts, although for clarity the description provided below uses an equal amplitude A for each carrier signal. The variations of the carrier signals over time t are defined in terms of frequency ω and angle θ, with the carrier signals at beam ports 102(j) and 102(j+1) differing in frequency so that the signal $u_i(t)$ at the ith antenna element is given by:

$$u_i(t) = A_{\sigma_i}\cos(\omega t + \theta + \sigma_i) + A_{\phi_i}\cos((\omega + \Delta\omega)t + (\theta + \Delta\theta) + \phi_i)$$
$$\equiv A\cos\alpha_i + A\cos\beta_i$$

for $$A \equiv A_{\sigma_i} = A_{\phi i};$$

$$\alpha_i = \omega t + \theta + \sigma_i;$$

and $$\beta_i = (\omega + \Delta\omega)t + (\theta + \Delta\theta) + \phi_i.$$

Intermodulation products may result from nonlinear aspects of amplification of $u_i(t)$ by the amplifier 104. For example, if the amplifier is modeled with a third-order series, the amplified signal $v_i(t)$ may be written as $$\begin{aligned} v_i(t) &= c_1 u_i(t) - c_3(u_i(t))^3 \\ &= \left(c_1 - \frac{9}{4}c_3A^2\right)A\cos\alpha_i + \left(c_1 - \frac{9}{4}c_3A^2\right)A\cos\beta_i - \\ &\quad \frac{1}{4}c_3A^3\cos 3\alpha_i - \frac{1}{4}c_3A^3\cos 3\beta_i - \frac{3}{4}c_3A^3\cos(2\beta_i + \alpha_i) - \\ &\quad \frac{3}{4}c_3A^3\cos(2\alpha_i - \beta_i) - \frac{3}{4}c_3A^3\cos(2\beta_i - \alpha_i) - \\ &\quad \frac{3}{4}c_3A^3\cos(2\alpha_i - \beta_i). \end{aligned}$$

The first two terms of this result are the two carrier signals at ω and (ω+Δω) respectively. The third through sixth terms are out-of-band intermodulation products and the last two terms are in-band intermodulation products. Antenna patterns for the two carrier signals and the two in-band intermodulation products, collectively corresponding to the four in-band signals, may be defined completely by the aperture phase distributions $\sigma_i$ and $\phi_i$ for all i, and correspond to different frequencies:

$$\begin{aligned} v_i^{(\omega)} &= \text{carrier signal at } \omega \\ &= \left(c_1 - \frac{9}{4}c_3A^2\right)A\cos(\omega t + \theta + \sigma_i); \end{aligned}$$

$$\begin{aligned} v_i^{(\omega+\Delta\omega)} &= \text{carrier signal at } \omega + \Delta\omega \\ &= \left(c_1 - \frac{9}{4}c_3A^2\right)A\cos((\omega + \Delta\omega)t + (\theta + \Delta\theta) + \phi_i); \end{aligned}$$

$$\begin{aligned} v_i^{(\omega+2\Delta\omega)} &= \text{intermodulation product at } 2(\omega + \Delta\omega) - \omega \\ &= -\frac{3}{4}c_3A^3\cos((\omega + 2\Delta\omega)t + (\theta + 2\Delta\theta) + 2\phi_i - \sigma_i); \text{ and} \end{aligned}$$

$$\begin{aligned} v_i^{(\omega-\Delta\omega)} &= \text{intermodulation product at } 2\omega - (\omega + \Delta\omega) \\ &= -\frac{3}{4}c_3A^3\cos((\omega - \Delta\omega)t + (\theta - \Delta\theta) + 2\sigma_i - \phi_i). \end{aligned}$$

It can be seen from these results that the aperture phase distributions for the intermodulation products combine in the same way as the frequencies. For example, the intermodulation product at 2(ω+Δω)−ω has aperture phase distribution $2\phi_i - \sigma_i$. If the aperture phase distributions of the carrier signals are identical, then the directivity pattern of the intermodulation products is the same as the directivity pattern of the carrier signals. However, if the aperture phase distributions are different, then the directivity pattern of each intermodulation product is different from the directivity patterns of the carrier signal. This property is exploited in embodiments of the invention by spreading the radiated energy from the intermodulation products substantially outside of the signal coverage region, resulting in an improvement in carrier-to-intermodulation isolation. Furthermore, while the preceding overview uses third-order intermodulation products as an illustration, similar results are also true for other orders of intermodulation products, including fifth order, seventh order, and the like. Accordingly, the invention is not limited to suppression of third-order intermodulation products, but may more generally be used in suppressing any desired order of intermodulation products.

In many commercial communications satellite applications, shaped contour directivity patterns may be used. This type of pattern can be produced by optimizing the aperture phase distribution for a fixed aperture power distribution. According to embodiments of the invention, different aperture phase distributions that produce substantially the same shaped contour directivity pattern may also be used to provide a net improvement in carrier-to-intermodulation isolation for shaped contour beam applications. In some embodiments, a second of the aperture phase distributions is substantially equal to a complex conjugate of a first of the aperture phase distributions, rotated by 180° in the aperture plane. In such instances, the first and second aperture phase distributions produce substantially the same radiation pattern. In particular, consider a two-dimensional aperture distribution f(x,y) having a Fourier transform defined by integration over the aperture ($j \equiv \sqrt{-1}$)

$$F(u,v) = \int\int dx\,dy\,df(x,y)e^{-2\pi ux j}e^{-2\pi vy j},$$

which is proportional to the electric-field distribution of the radiation pattern in the far field. The inverse Fourier transform is $$f(x,y) = \int\int du\,dv\,F(u,v)e^{2\pi ux j}e^{2\pi vy j},$$

from which it follows that the complex conjugate of F(u,v) is given by $$F^*(u,v) = \int\int dx\,dy\,f^*(-x,-y)e^{-2\pi ux j}e^{-2\pi vy j}.$$

The directivity pattern of the active array is proportional to $|F(u,v)|^2$, and both f(x,y) and f*(−x,−y) produce the same directivity pattern because $$|F(u,v)|^2 = |F^*(u,v)|^2.$$

Figure 2A:
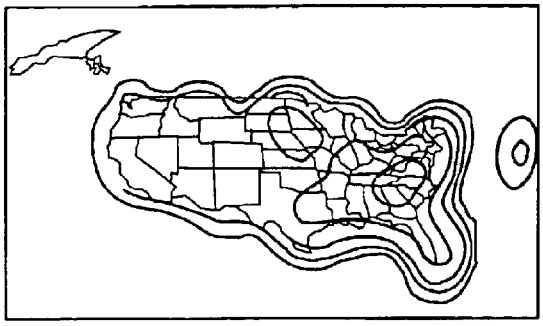
FIGS. 2A-2F provide illustrations of radiation patterns generated with certain aperture phase distributions.
Figure 2B:
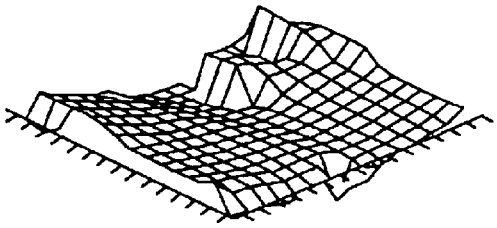
Figure 2C:
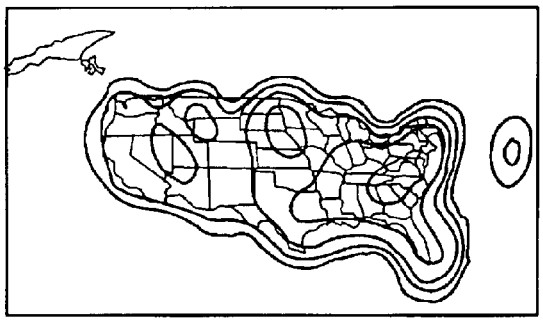
Figure 2D:
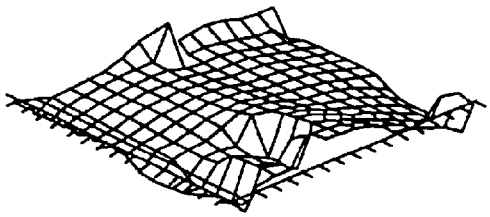

The use of such properties in one embodiment of the invention is illustrated with FIGS. 2A-2F. FIG. 2A provides an example of a shaped contour directivity pattern, in this instance of the Continental United States ("CONUS"). This pattern was produced by the aperture phase distribution shown in FIG. 2B with a uniform aperture power distribution. Similarly, FIG. 2C also provides an example of a shaped contour directivity pattern produced by the aperture phase distribution shown in FIG. 2D, also with a uniform aperture power distribution. The aperture phase distributions in FIGS. 2B and 2D are related by complex conjugation and 180° rotation in the aperture plane, and the corresponding directivity patterns shown in FIGS. 2A and 2C are substantially identical.

Figure 2E:
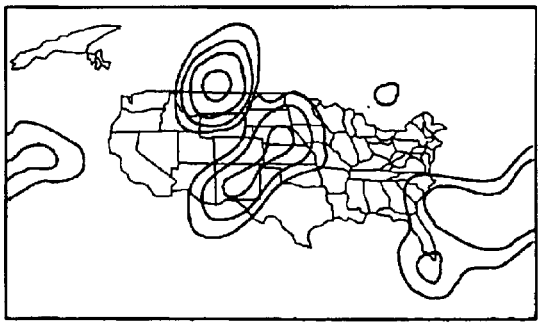
Figure 2F:
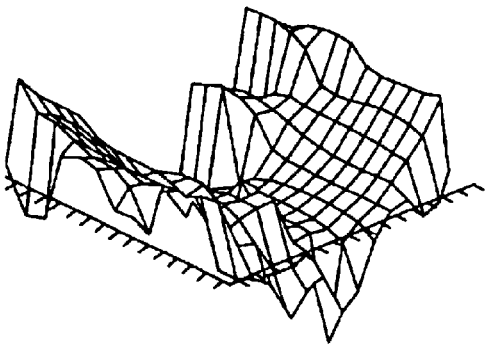

FIGS. 2E and 2F illustrate benefits that may result from having a first carrier signal that uses the aperture phase distribution shown in FIG. 2B and having a second carrier signal that uses the aperture phase distribution shown in FIG. 2D. Specifically, FIG. 2E illustrates the radiation pattern of the second in-band intermodulation product $v_i^{(\omega-\Delta\omega)}$ corresponding to the two carrier signals and FIG. 2F provides the aperture phase distribution for that intermodulation product. As is evident from the figures, the aperture phase distribution for the intermodulation product is more distorted than the aperture phase distribution corresponding to either of the carrier signals, with the consequence that the radiation pattern directivity of the intermodulation product is greatly reduced in most of the CONUS coverage area. Over most of the coverage area, the carrier-to-intermodulation isolation was improved by 4–8 dB, with an average improvement of about 7.5 dB. It is noted, however, that in two small confined areas, the carrier-to-intermodulation isolation is worsened. This is addressed in part by the optimization discussed in further detail below. An average improvement of 5–7 dB in carrier-to-intermodulation isolation may permit an increase in EIRP of the radiation power of about 1 dB for the same bias power.

The example of FIGS. 2A-2F illustrates that embodiments of the invention permit manipulation of the aperture phase distributions of the carrier signals so that they substantially correspond to respective coverage areas, while simultaneously suppressing the effects of intermodulation products over the coverage areas. To take advantage of the reduction in the average intermodulation patterns, and since those patterns may be produced to be fundamentally different from the signal patterns, the intermodulation patterns may be suppressed to a specified level while simultaneously maximizing the signal patterns on a worst-case basis.

The example of two carrier signals is intended to be illustrative and not limiting, and in other embodiments a greater number of carrier signals may be accommodated. Also, as previously mentioned, the invention is not intended to be limited to suppressing the effects of third-order intermodulation products, but applies more generally to any intermodulation products. This is true, for example, also for embodiments in which the amplifiers 104 introduce phase nonlinearities in addition to amplification nonlinearities. In some embodiments, the manipulation of aperture phase distributions may simultaneously increase carrier signal directivity and suppress intermodulation-product directivity.

Figure 3A:
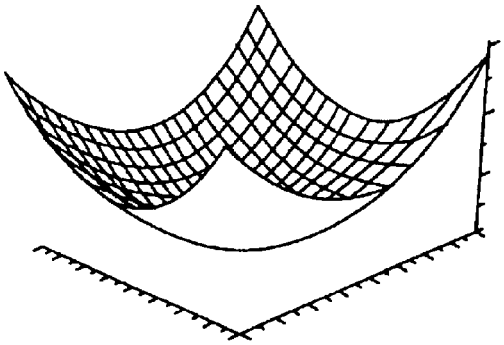
FIGS. 3A-3D provide examples of initial aperture phase distributions allocated according to embodiments of the invention in determining aperture phase distributions that suppress intermodulation products.
Figure 3D:
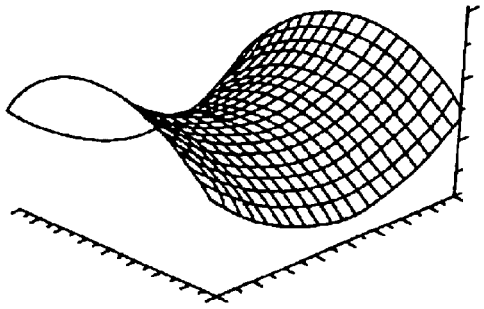
Figure 3B:
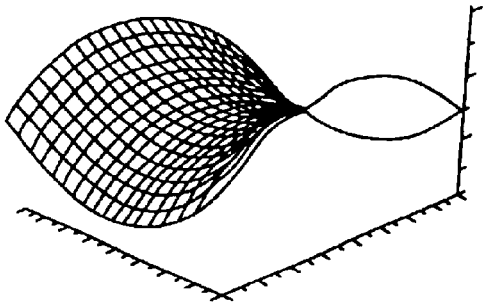
Figure 3E:
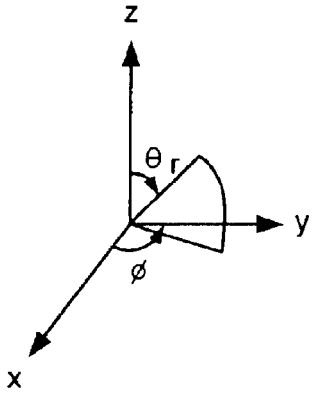
FIG. 3E defines a spherical coordinate system used in discussions of the aperture phase distributions.
Figure 3C:
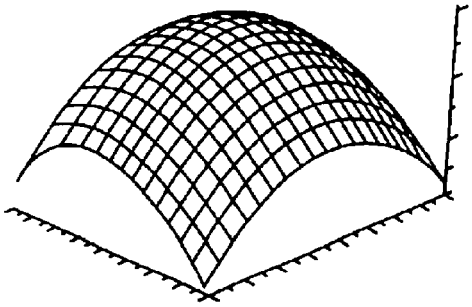

In a specific set of embodiments, the manipulation of the aperture phase distributions is facilitated by allocating distinct initial aperture phase distributions to the carriers. Merely by way of example, four such initial aperture phase distributions are illustrated in FIGS. 3A-3D. Two of the initial aperture phase distributions, i.e. those shown in FIGS. 3A and 3C, are paraboloidal and are examples of initial aperture phase distributions that have two planes of symmetry about an axis orthogonal to the aperture plane. These two particular initial aperture phase distributions are also related to each other as described above by complex conjugation and a 180° rotation of the underlying complex aperture voltage distributions. Another two of the initial aperture phase distributions, i.e. those shown in FIGS. 3B and 3D, are hyperbolically paraboloidal (sometimes referred to herein as having "saddle" distributions) and are examples of initial aperture phase distributions that are asymmetric about the axis orthogonal to the aperture plane. These two particular initial aperture distributions are also related to each other according to complex conjugation and a 180° rotation of underlying complex aperture voltage distributions.

The collective set of initial aperture phase distributions shown in FIGS. 3A-3D may be considered to define a basis set that may be used in contoured-beam applications having up to four channels simultaneously. FIG. 3E in the center of FIGS. 3A-3D defines a spherical polar coordinate system used below in discussing the basis set. In applications that have more than four channels, elements of such a basis set may be used more than once, as described further below, although in some embodiments a larger basis set may alternatively be used. For instance, the paraboloidal distributions of FIGS. 3A and 3C are constant with polar angle $\phi$, and the saddle distributions of FIGS. 3B and 3D have variations of $\cos\phi$; other initial aperture phase distributions could have variations of $\cos n\phi$ for integer $n>1$. In still other embodiments, initial aperture phase distributions could be provided with other variations in $\phi$ or even with different r variations.

Figure 4:
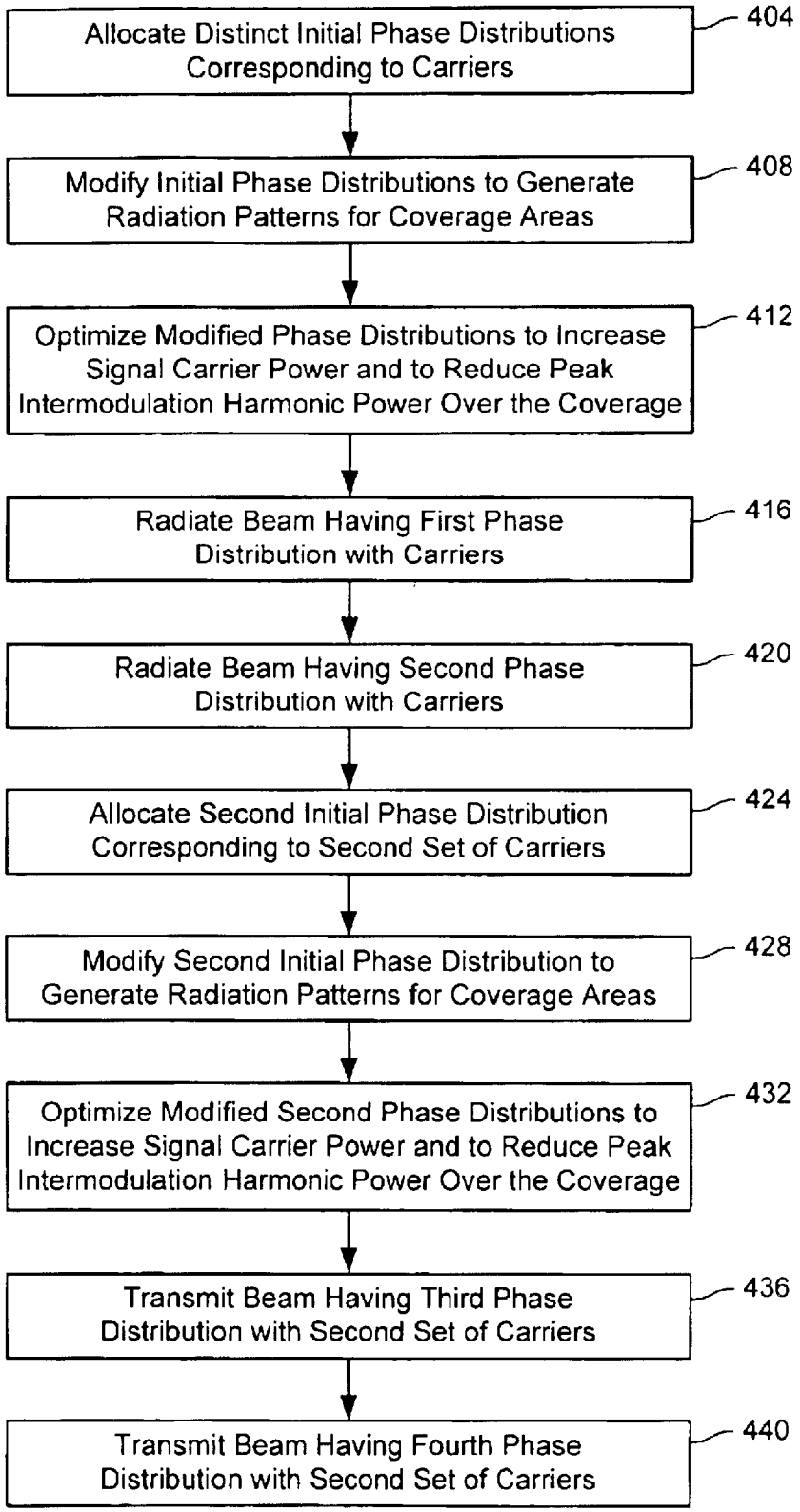
FIG. 4 provides a flow diagram that summarizes methods for determining aperture phase distributions for use in radiating signals with an active phased array antenna according to embodiments of the invention.

Use of a plurality of such initial aperture phase distributions in suppressing the intermodulation products over coverage areas is summarized with the flow diagram of FIG. 4. At block 404, the distinct initial aperture phase distributions are allocated to correspond to the carriers. These initial aperture phase distributions are modified at block 408 to generate radiation patterns for the coverage areas. Such modification may include beam shaping or optimization, for both contour and side lobes, for each of the carrier channels. At block 412, the modified aperture phase distributions are used as initial distributions in an optimization to increase signal carrier power and reduce peak intermodulation-product power over the coverage. As used herein, the terms "optimize" and "optimization" are intended to produce an improvement in a parameter, but do not require that no further improvement be possible for the parameter. For example, in some embodiments, the optimization performed at block 412 may comprise performing worst-case optimization for increasing a minimum EIRP (sometimes referred to as "min/max optimization") with constrained sidelobe isolation to keep the sidelobe energy under a specified level, while improving the carrier-to-intermodulation isolation. Once the optimized modified aperture phase distributions have been determined, they may be used for radiating beams with the carrier channels as indicated at blocks 416 and 420.

The set of blocks 424–440 is intended to illustrate one manner in which the method may be extended in embodiments where the number of carriers is greater than the number of basis initial aperture phase distributions. Essentially, the same procedure is performed but with at least some of the initial aperture phase distributions being used for multiple carriers. Thus, at block 424, second initial aperture phase distributions are allocated to correspond to a second set of carriers, with each of the second initial aperture phase distributions being substantially equal to one of the initial aperture phase distributions. The second initial aperture phase distributions are also modified, as indicated at block 428, to generate radiation patterns for the coverage areas. These modified second aperture phase distributions are also optimized, as indicated at block 432, to increase signal carrier power and reduce a peak intermodulation product over the coverage area, which may reflect the effects of both the modified aperture phase distributions and the second modified aperture phase distributions. As indicated at blocks 436 and 440, beams may be radiated with the second set of carriers according to the optimized second aperture phase distributions.

Figure 5A:
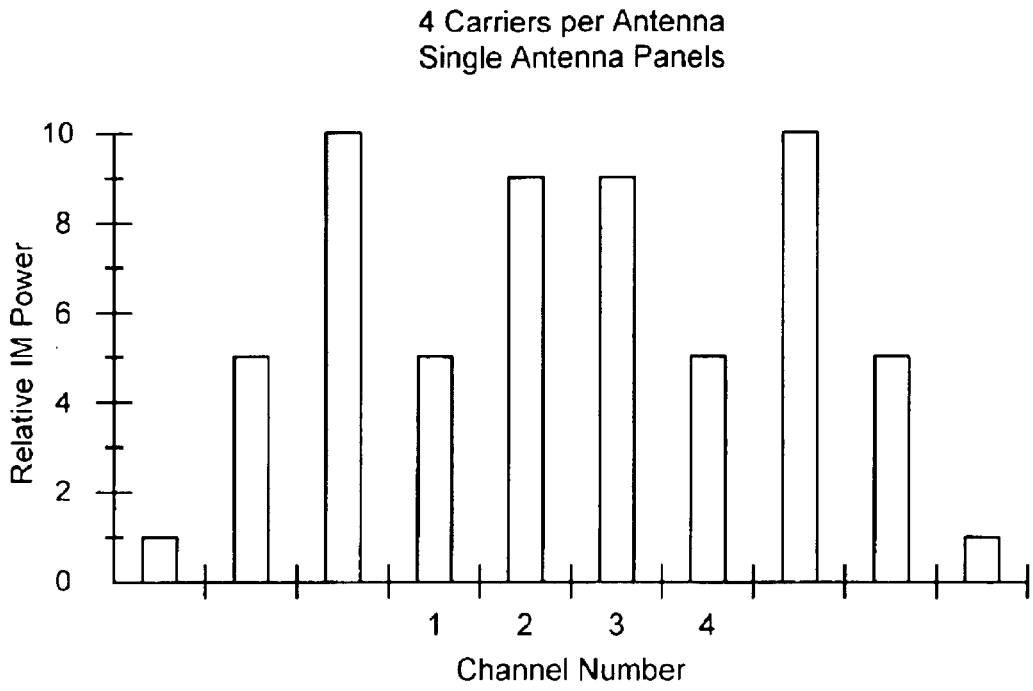
FIGS. 5A and 5B provide a comparison of relative intermodulation power distributions for different frequency-band characteristics.
Figure 5B:
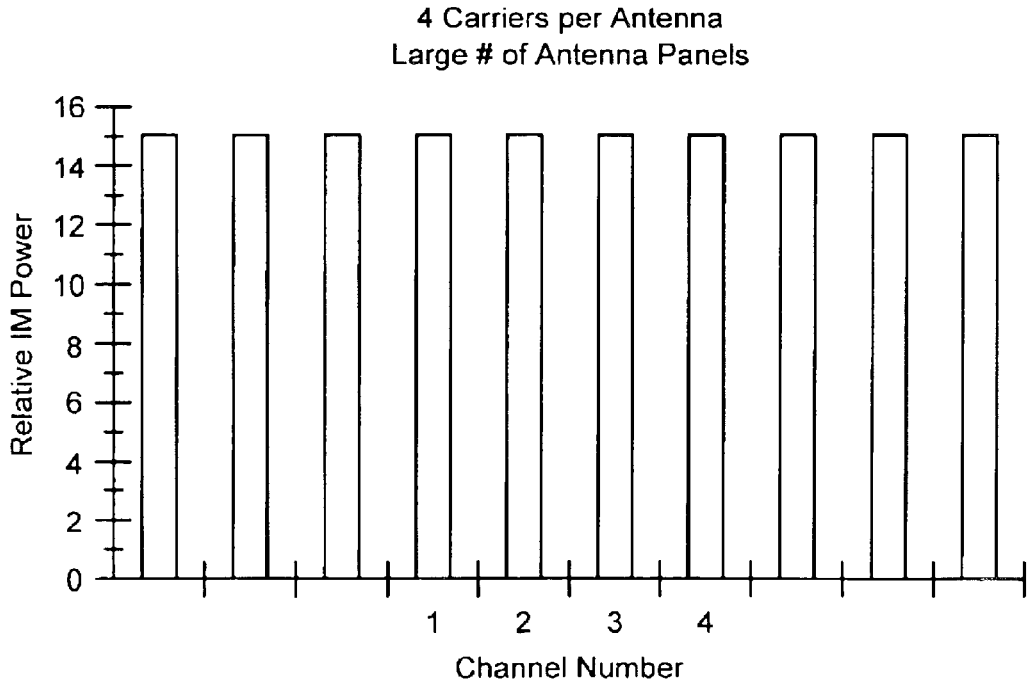

In performing the optimizations at blocks 412 and/or 432 for intermodulation products, the intermodulation power radiated within a certain frequency band may be found by adding the different intermodulation contributions. For example, in the case of two adjacent carrier channels per antenna, only one intermodulation product falls inside of each channel. For four adjacent carrier channels per antenna, the intermodulation power spectrum may be distributed as shown in FIG. 5A. If, however, the frequency band is separated into a plurality of adjacent four-carrier sub-bands, with each sub-band used by a single antenna generating identical patterns, the power spectrum may be substantially uniform as shown in FIG. 5B.

Also, in some embodiments the optimizations performed at blocks 412 and 432 may account for a plurality of intermodulation products. In the optimizations, the number of independent products may depend on the allocation of initial aperture phase distributions performed at block 404. For example, in a two-carrier case, one of the initial aperture phase distributions could be a paraboloidal aperture phase distribution and the other could be a saddle aperture phase distribution. In such a case, the number of third-order in-band intermodulation patterns is two and it may thus be desirable to include the two signal patterns and two intermodulation patterns in the optimization. If, however, a transformed pair of distributions is used for the initial aperture phase distributions, i.e. the two paraboloidal distributions of FIGS. 3A and 3C or the two saddle distributions of FIGS. 3B and 3D, symmetry considerations may reduce the number of patterns in the optimization without compromising the scope of the optimization. In particular, the optimizations could be performed with only one signal pattern and one third-order in-band intermodulation pattern, thereby reducing computational time significantly. The use of such symmetry considerations may be even more valuable in embodiments with a greater number of carriers. For example, in a four-carrier case, the symmetries exemplified by the initial aperture phase distributions shown in FIGS. 3A-3D may allow the optimizations to be performed for two signal patterns and twelve third-order in-band intermodulation patterns without compromising the scope that would be provided by using all four signal patterns and twenty-four third-order in-band intermodulation patterns.

In some embodiments, the effect of the optimizations may be understood by considering two regions within the coverage areas. The minimum EIRP for each carrier is maximized for a first of the regions. Maximum sidelobes are suppressed over a second of the regions to be reused at the same frequency. Maximum intermodulation patterns per channel are suppressed over the first and second regions; the intermodulation patterns that are suppressed will usually include third-order in-band intermodulation patterns, but may additionally include fifth-order or even higher-order intermodulation patterns. The first and second regions may be identical, partially overlapping, totally separated, or one of the regions may be completely contained within the other.

EXAMPLES

The inventors have performed a number of simulations to illustrate the suppression of intermodulation products using the methods described above. In performing these simulations, operation of the amplifiers 104 has been incorporated with the Shimbo model as described in O. Shimbo, *Transmission Analysis in Communication Systems* (Computer Science Press, 1988) and O. Shimbo, "Effects of intermodulation, AM-PM conversion, and additive noise in multicarrier TWT systems," Proc. IEEE, 59, 230–238 (February 1971), the entire disclosures of both of which are incorporated herein by reference for all purposes. The validity of this model is illustrated with FIGS. 6A-6E, which compare measured properties of a particular amplifier with properties produced by the Shimbo model used in the simulations. In all cases, the solid line in the figure shows the measured properties and the dashed line shows the model properties.

Figure 6A:
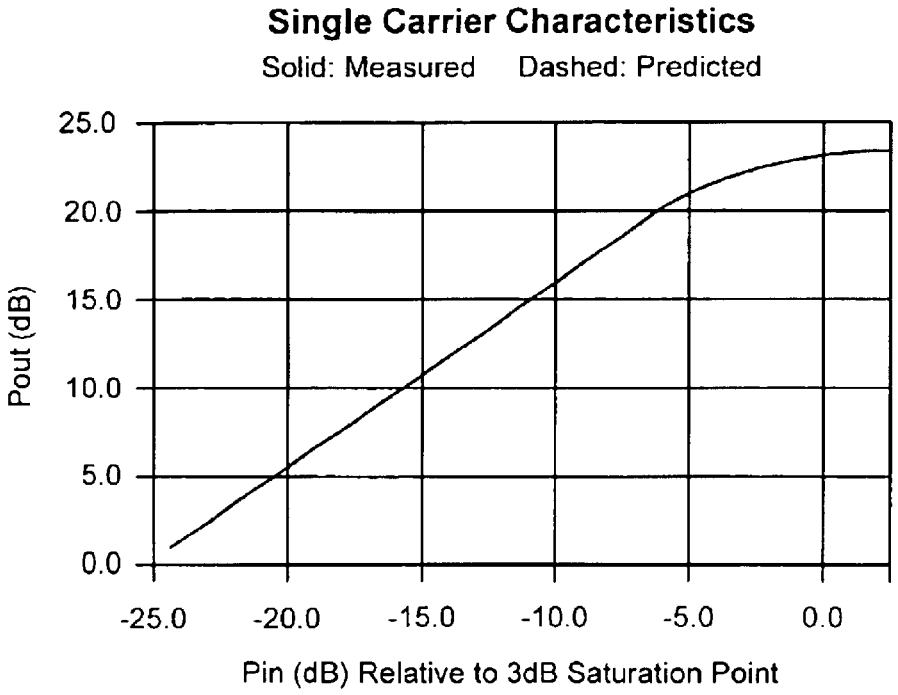
FIGS. 6A-6E illustrate SSPA characteristics used in illustrating certain embodiments of the invention.
Figure 6B:
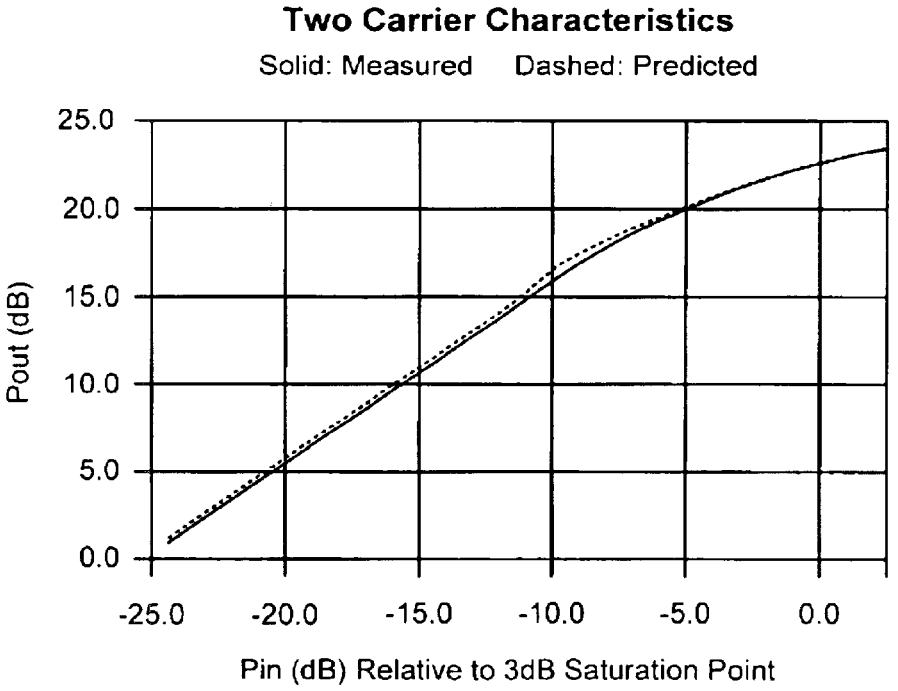
Figure 6C:
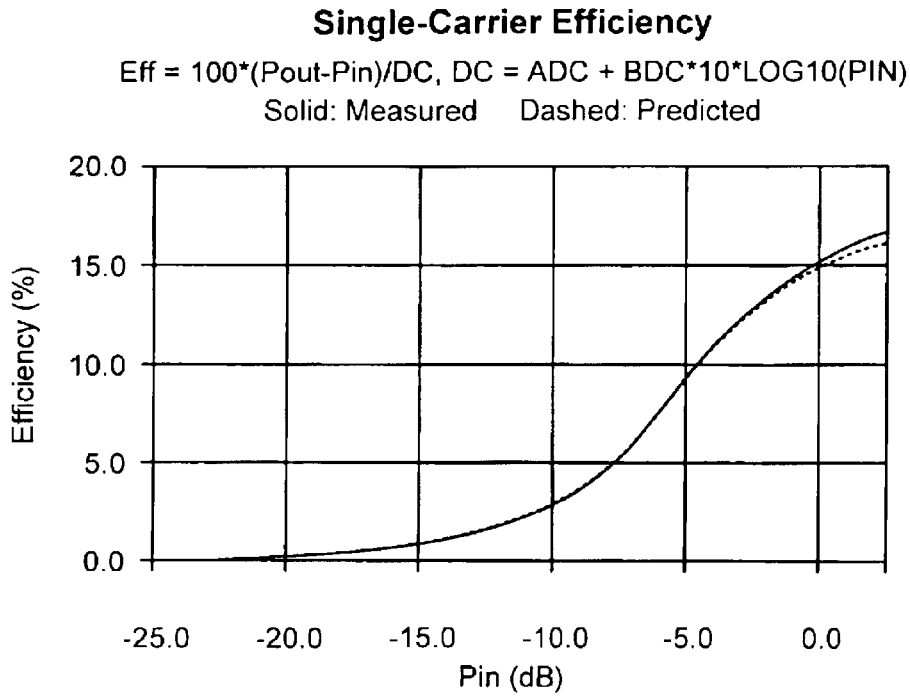

FIG. 6A provides a comparison of typical amplifier output power $P_{out}$ as a function of input power $P_{in}$ relative to the saturation point for a single carrier. Similarly, FIG. 6B provides a comparison of $P_{out}$ with $P_{in}$ for two carriers. The efficiency for the amplifiers is compared in FIGS. 6C and 6D as a function of $P_{in}$ respectively for single and two carriers. The production of intermodulation products with two carriers is illustrated with FIG. 6E, which plots the carrier strength to third-order intermodulation-product strength $C/I_3$ as a function of $P_{in}$. It is clear from the figures that the model reproduces the measured characteristics of the amplifiers well.

Figure 6D:
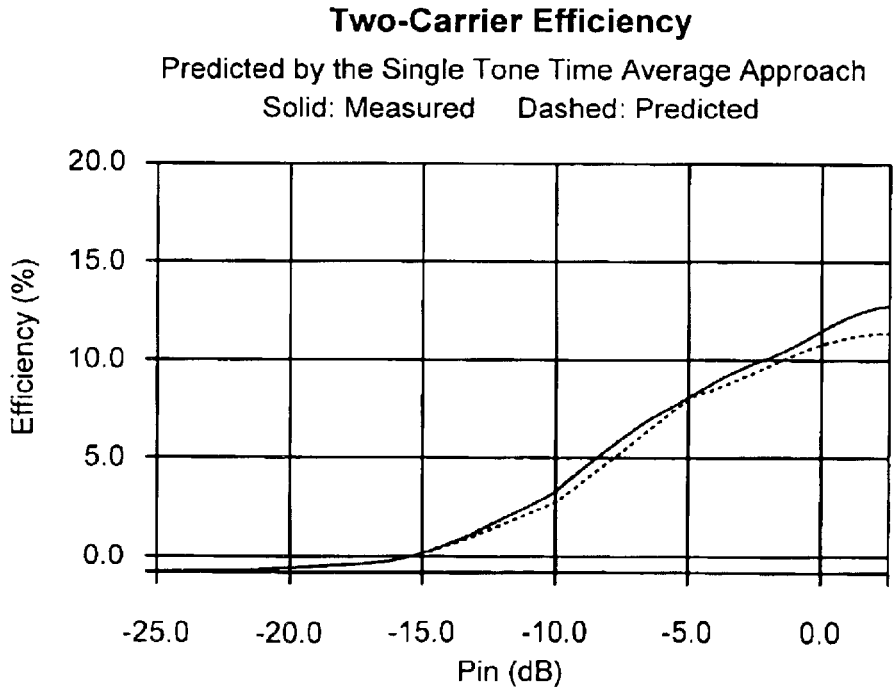
Figure 6E:
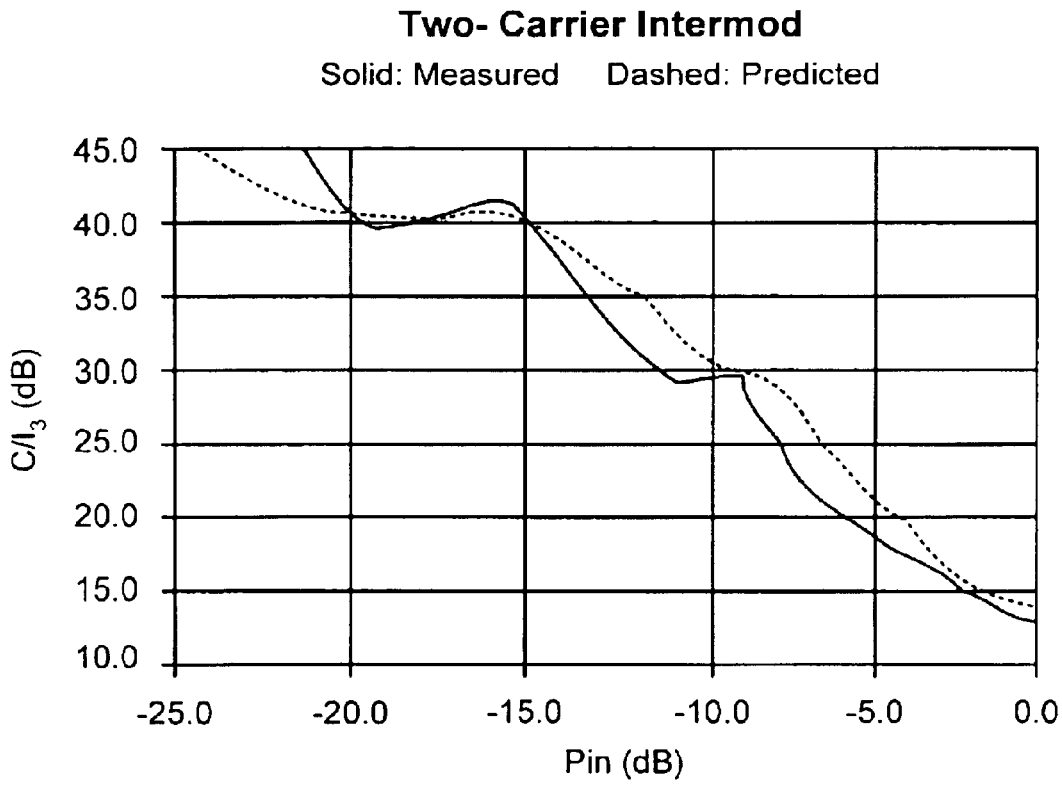

For the two-carrier case, the efficiency shown in FIG. 6D is calculated with the single-tone time-average approach ("STTAA"), which averages the efficiency of an instantaneous single-tone modulated signal over a modulation cycle using the efficiency characteristic for a single carrier and by using Monte Carlo simulations to account for the random phase between carriers. For an arbitrary number of carriers n, the modulated signal is defined as a function of time t by the complex envelope $$e(t) = \sum_{i=1}^{n} a_i e^{j\omega_i 1+\phi_i}$$

for amplitudes $a_i$, frequencies $\omega_i$, and phases $\phi_i$. In the particular case of two carriers n=2, this envelope may be calculated deterministically:

$$\begin{aligned} e(t) &= a_1 \exp\left[j\left(\omega t - \frac{\Delta\omega}{2}t\right) - \frac{\phi}{2}\right] + a_2 \exp\left[j\left(\omega t + \frac{\Delta\omega}{2}t\right) + \frac{\phi}{2}\right] \\ &= e^{j\omega t}\left[a_1 \exp\left[-j\left(\frac{\Delta\omega}{2}t + \frac{\phi}{2}\right)\right] + a_2 \exp\left[j\left(\frac{\Delta\omega}{2}t + \frac{\phi}{2}\right)\right]\right] \\ &= A(\theta) e^{j(\omega t + \psi(t))}, \end{aligned}$$

where $$A(\theta) = \sqrt{a_1^2 + a_2^2 + 2a_1 a_2 \cos(\Delta\omega t + \phi)} \text{ and}$$

$$\psi(t) = \frac{a_2 - a_1}{a_2 + a_1} \tan\left(\frac{\Delta\omega}{2}t + \frac{\phi}{2}\right).$$

In the particular case where the single-tone amplitudes are uniform, $a_1 = a_2 \equiv a$, the envelope takes the closed-form expression $$e(t) = 2a e^{j\omega t} \cos\left(\frac{\Delta\omega}{2}t + \frac{\phi}{2}\right),$$

representing a modulated signal with modulation frequency $\Delta\omega$. When the number of carriers n is greater than two, the envelope may be calculated using a probabilistic simulation with the relative phases $\phi_i$ treated as random variables. The results of simulations described herein for more than two carriers use a Monte Carlo technique to perform the probabilistic simulation.

Results of the simulations are presented in FIGS. 7A-19. These simulations were based on active phased array antennas with 16×16 (3λ×3λ) antenna elements and uniform power distribution over the array aperture, with two or four carrier channels per antenna, and an extended CONUS coverage that includes Alaska, Hawaii, and Puerto Rico in addition to the Continental United States. In some of the discussion of the figures below, comparisons are made with active phased array antennas operated with backed-off amplifiers for the same carrier/intermodulation $C/I_3$ (where C refers to the carrier signal and $I_3$ refers to the third-order intermodulation signal) requirement to illustrate improvements in intermodulation suppression that may be achieved with embodiments of the invention.

Figure 7A:
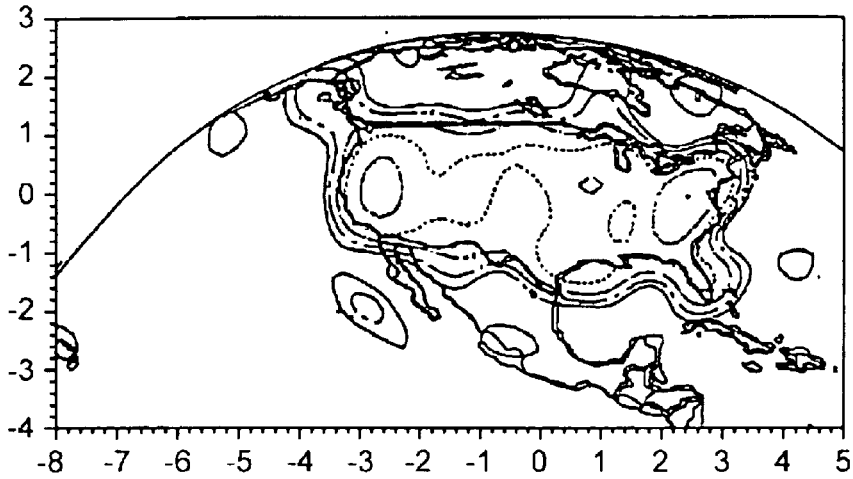
FIGS. 7A and 7B provide examples of signal patterns generated in accordance with embodiments of the invention.
Figure 7B:
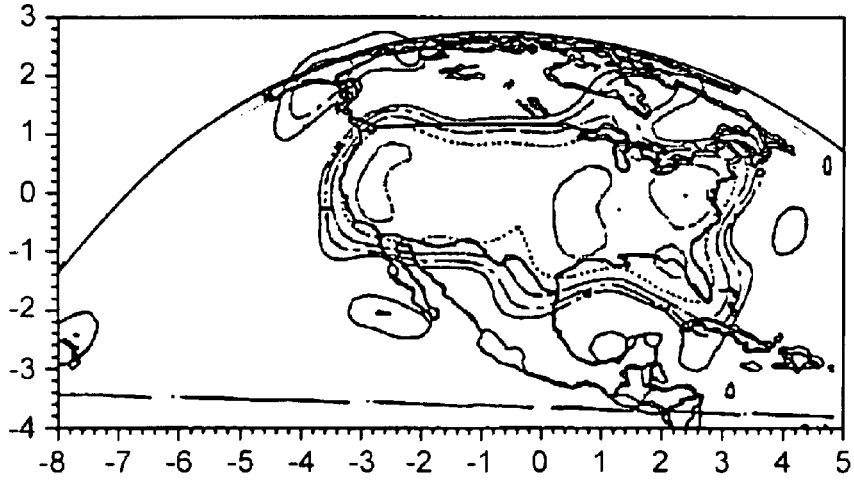
Figure 8A:
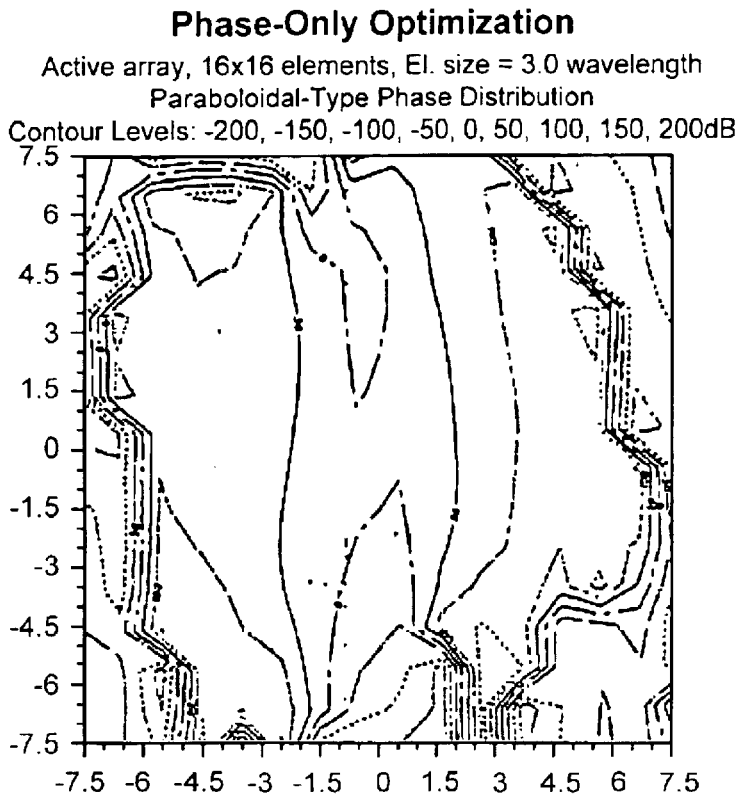
FIGS. 8A and 8B provide examples of aperture phase distributions used in generating the signal patterns shown in FIGS. 7A and 7B.
Figure 8B:
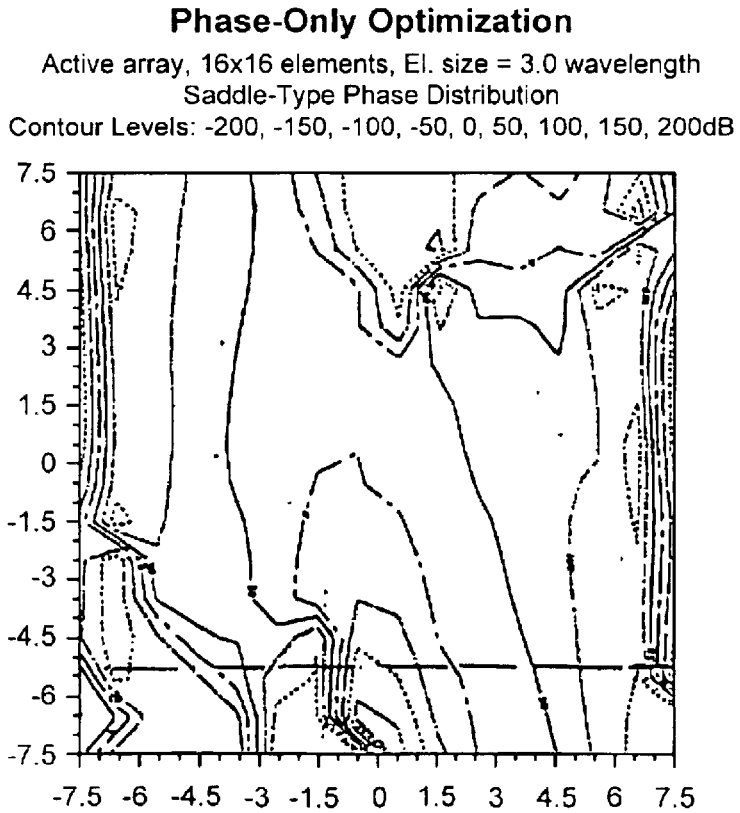

Signal patterns optimized with respect to EIRP only, and not including intermodulation optimization, are provided in FIGS. 7A and 7B. The results of FIG. 7A were determined using a paraboloidal aperture phase distribution as the initial aperture phase distribution and the results of FIG. 7B were determined using a saddle aperture phase distribution as the initial aperture phase distribution. Since no constraint was imposed for these simulations on $C/I_3$ values, the amplifiers can be operated saturated. The minimum EIRP values for the two cases differ by only 0.27 dB, although the detailed pattern shapes show differences in the figures. FIGS. 8A and 8B provide optimized aperture phase distributions that correspond to the results in FIGS. 7A and 7B, i.e. FIG. 8A shows results determined using the paraboloidal aperture phase distribution as the initial aperture phase distribution and FIG. 8B shows results determined using the saddle aperture phase distribution as the initial aperture phase distribution.

Figure 9A:
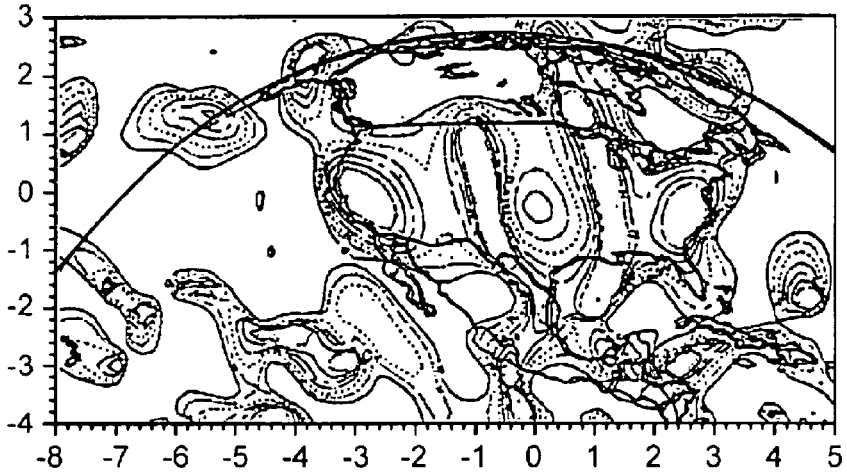
FIGS. 9A and 9B provide examples of $C/I_3$ patterns corresponding to the aperture phase distributions of FIGS. 8A and 8B.
Figure 9B:
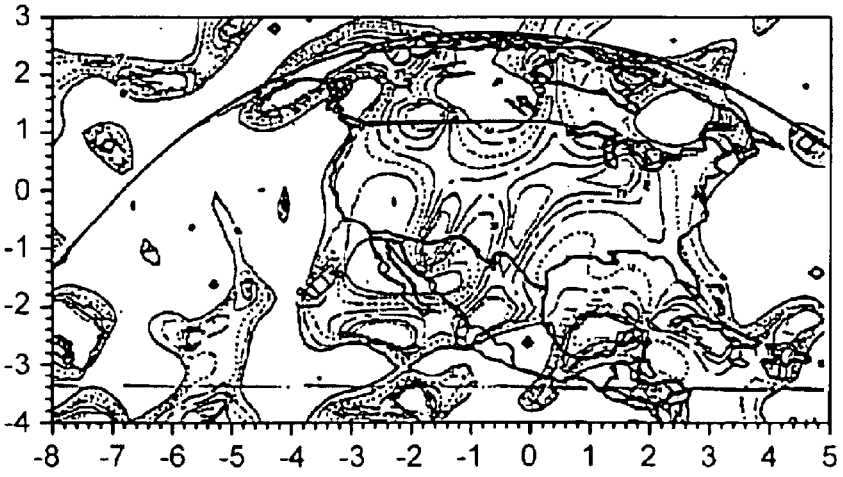

The results shown in FIGS. 9A and 9B provide $C/I_3$ patterns for two carriers, and were again determined by optimizing with respect to EIRP only, and without intermodulation optimization. The results of FIG. 9A were determined using a transformed pair of paraboloidal aperture phase distributions as the initial aperture phase distributions and the results of FIG. 9B were determined using a transformed pair of saddle aperture phase distributions as the initial aperture phase distributions. The minimum $C/I_3$ level for the paraboloidal aperture phase distributions is about 11.5 dB and the minimum C/Ilevel for the saddle aperture phase distributions is about 12.0 dB. The $C/I_3$ level at the output of the SSPA is about 14 dB, which shows that the minimum $C/I_3$ value has gotten worse. In both cases, the average levels are well below 20 dB, indicating that the intermodulation products can be suppressed even without significant EIRP reduction.

Figure 10:
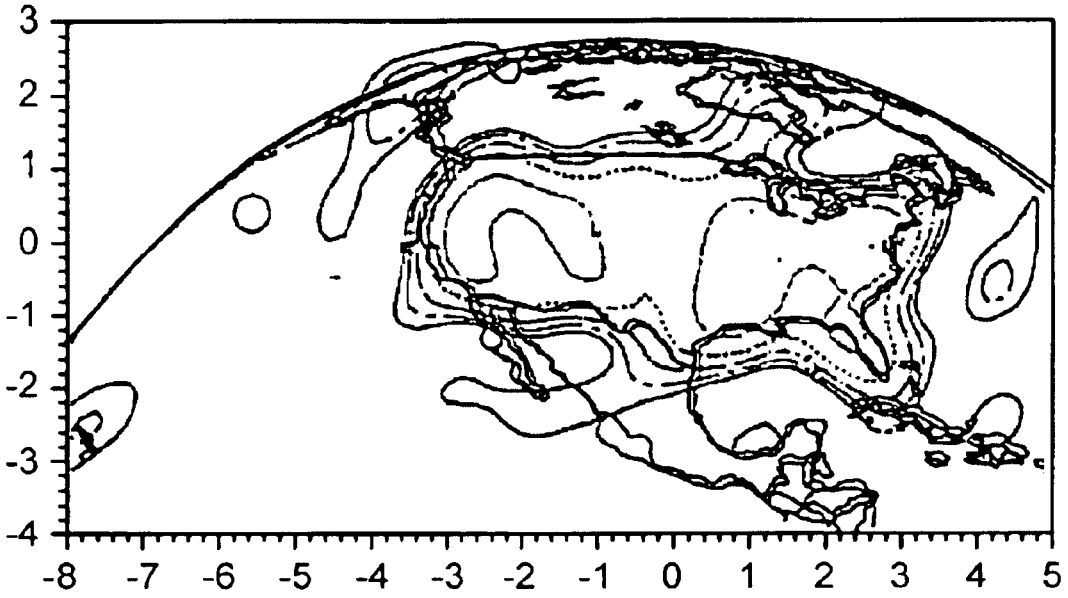
FIG. 10 provides an example of an effective isotropic radiated power ("EIRP") pattern determined for an exemplary embodiment of the invention.
Figure 11A:
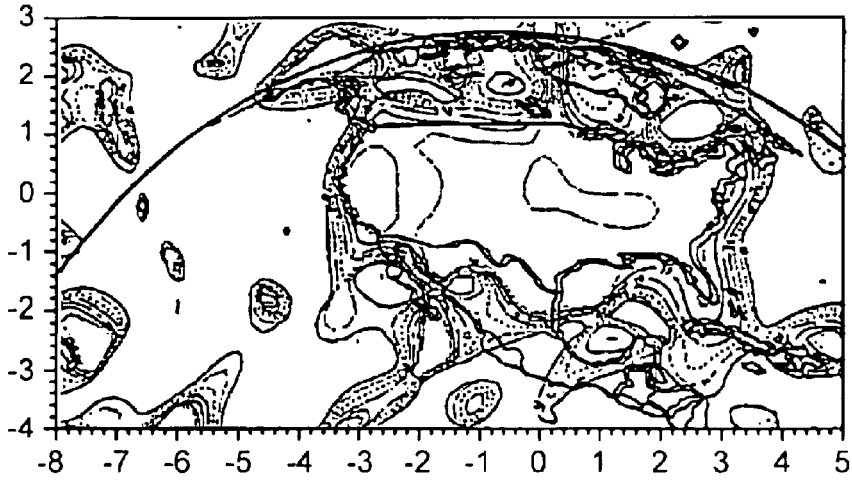
FIGS. 11A and 11B provide examples of intermodulation ISOLATION patterns determined for an exemplary embodiment of the invention.
Figure 11B:
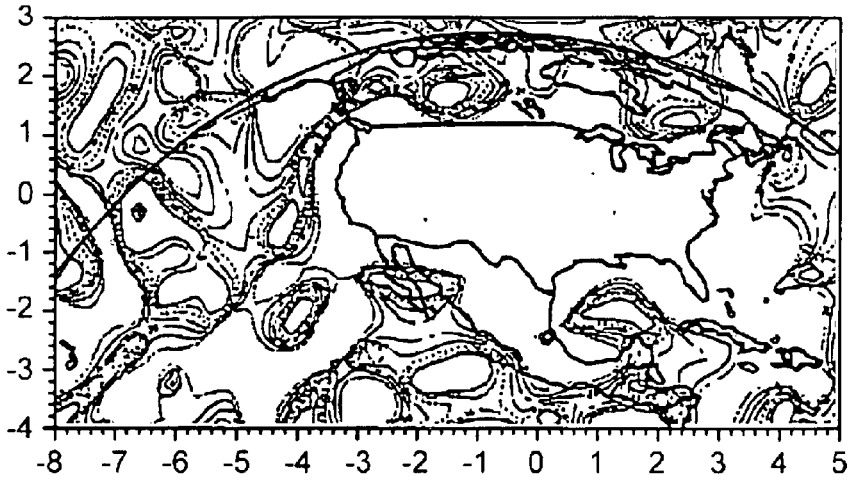

FIGS. 10-10B provides results to illustrate the effect of further optimization with respect to $C/I_3$. The results presented in these figures were determined using the saddle initial aperture phase distributions, although qualitatively similar results are expected also for the use of the paraboloidal initial aperture phase distributions. FIG. 10 shows the EIRP pattern that results from further optimization with respect to $C/I_3$ while FIGS. 11A and 11B respectively show the corresponding $C/I_3$ and $C/I_5$ patterns. The result of combining optimization with respect to EIRP and to $C/I_3$ reduces the minimum $C/I_3$ level to 23.4 dB at the modest expense of a 0.17 dB reduction in minimum EIRP. In addition, the minimum $C/I_5$ level is also improved from about 20.7 dB for a conventional non-optimized result to about 27.4 dB using the methods of the invention.

A summary of the improvement that is achieved in specific embodiments of the invention when compared with certain prior-art results is provided in FIGS. 12-19. Results determined in accordance with these embodiments of the invention are compared with results resulting from the conventional approach of mitigating the effects of intermodulation products by backing off the amplifiers 104. The results in FIGS. 12-15 are provided for embodiments having two carriers while the results in FIGS. 16-19 are provided for embodiments having four carriers.

Figure 12:
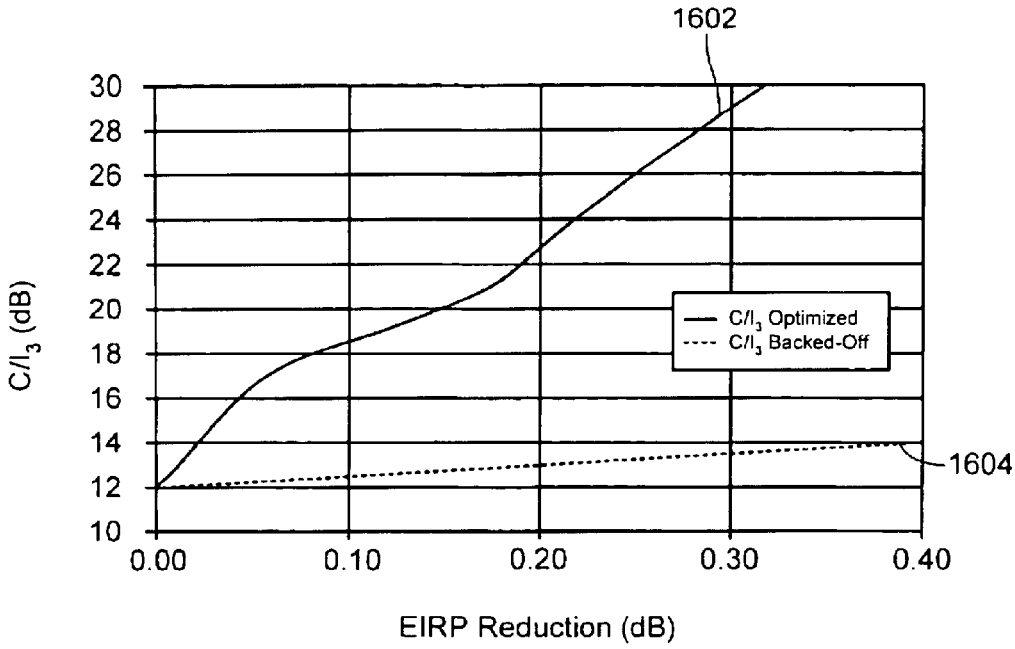
FIG. 12 provides a comparison of $C/I_3$ versus EIRP reduction for an embodiment of the invention using two carriers against a prior-art result.

Curve 1602 of FIG. 12 shows the $C/I_3$ improvement resulting from the methods of the invention while curve 1604 shows the $C/I_3$ improvement resulting from conventional backing off the amplifiers 104. It is apparent that the methods of the invention achieve a significantly greater improvement in this embodiment, with $C/I_3$ equal to almost 30 dB at an EIRP reduction of 0.30 dB using the methods of the invention and equal to only about 14 dB at the same EIRP reduction with the amplifiers 104 backed off.

Figure 13:
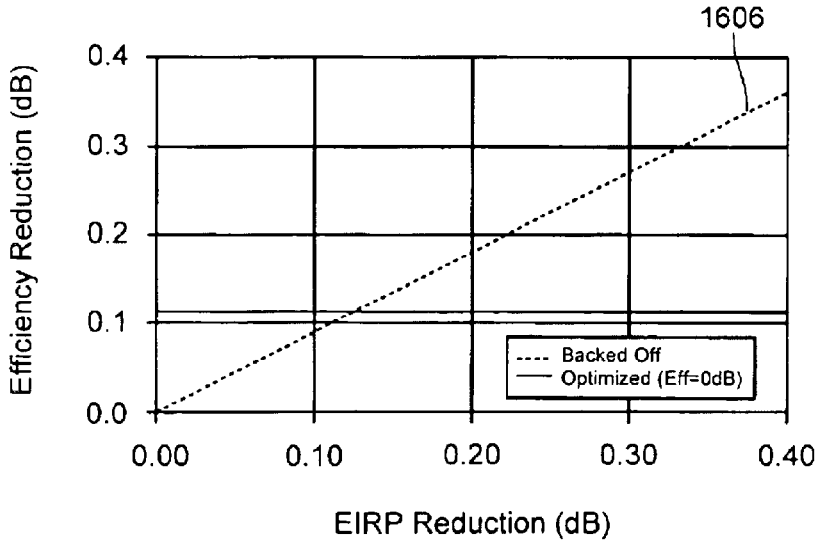
FIG. 13 provides a comparison of efficiency reduction versus EIRP reduction for an embodiment of the invention using two carriers against a prior-art result.

FIG. 13 shows the relative efficiency reduction as a function of EIRP reduction in this embodiment of the invention and for a conventional backing off of the amplifiers 104. Curve 1606 corresponds to the result for backing off the amplifiers 104, while results using the methods of the invention result in zero efficiency reduction. The fact that there is no efficiency reduction when the methods of the invention are used may be attributed to the fact that the amplifiers 104 remain saturated over the entire EIRP and $C/I_3$ range investigated.

Figure 14:
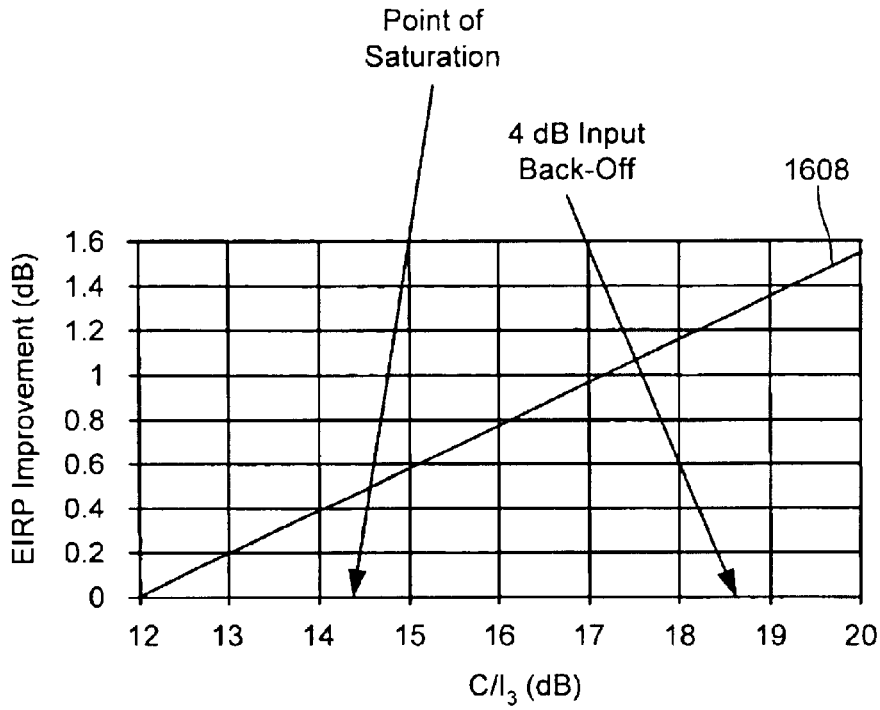
FIG. 14 provides a comparison of EIRP improvement versus $C/I_3$ for an embodiment of the invention using two carriers against a prior-art result.
Figure 15:
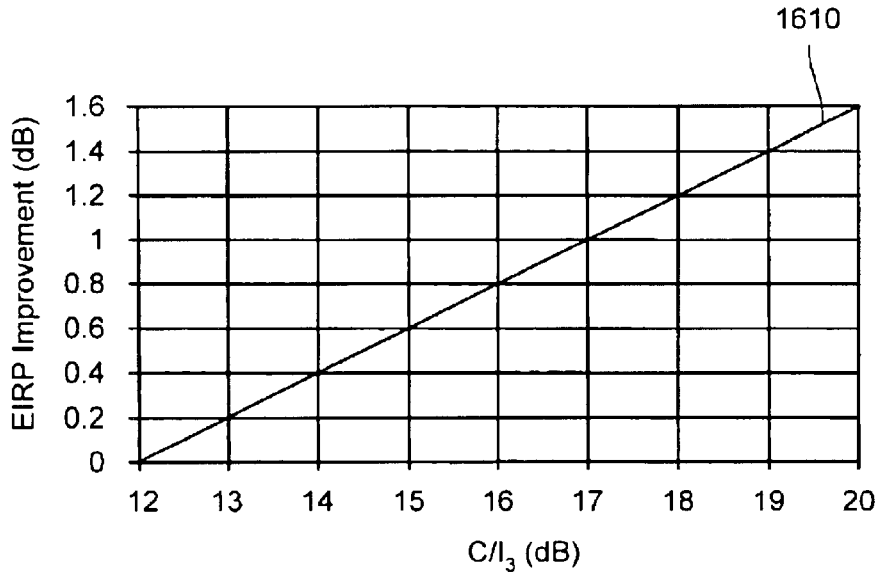
FIG. 15 provides a comparison of efficiency improvement versus $C/I_3$ for an embodiment of the invention using two carriers against a prior-art result.

Curve 1608 of FIG. 14 shows the EIRP improvement that results as a function of $C/I_3$ in this embodiment of the invention as compared with backing off the amplifiers 104. Similarly, curve 1610 of FIG. 15 shows the efficiency improvement that results, also as a function of $C/I_3$. The efficiency curves 1606 and 1610 in FIGS. 13 and 15 were determined by averaging data points computed from a Monte Carlo simulation based on the statistical signal for e(t) discussed above. The results shown in FIGS. 14 and 15 demonstrate that the methods of the invention result in an improvement in both EIRP and efficiency. For example, at $C/I_3$ equal to 18.6 dB, which corresponds to a 4 dB input back-off in the conventional approach, the EIRP is improved by about 1.3 dB and the efficiency is improved by about 1.3 dB.

Figure 16:
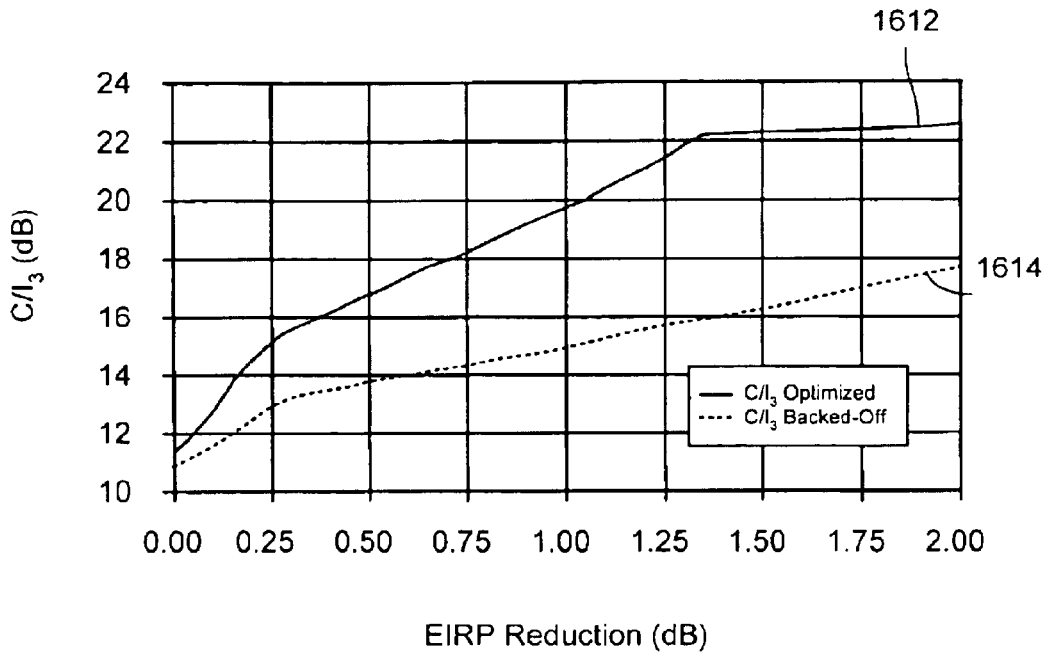
FIG. 16 provides a comparison of $C/I_3$ versus EIRP reduction for an embodiment of the invention using four carriers against a prior-art result.
Figure 17:
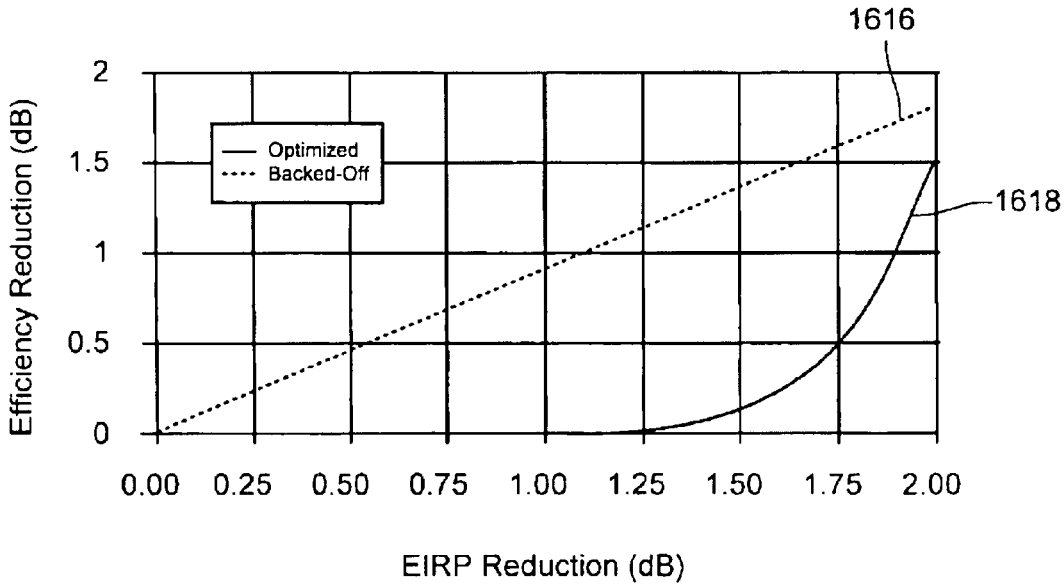
FIG. 17 provides a comparison of efficiency reduction versus EIRP reduction for an embodiment of the invention using four carriers against a prior-art result.

Similar results are evident in the four-carrier case, as illustrated in FIGS. 16-19. FIG. 16 shows the dependence of $C/I_3$ in the embodiment of the invention (curve 1612) and for the prior-art amplifier back-off (curve 1614) as a function of EIRP reduction. It is evident that a greater suppression of the intermodulation products is achieved in the embodiment of the invention. FIG. 17 shows the dependence of the efficiency reduction on the EIRP reduction, with curve 1618 corresponding to results using the methods of the invention and curve 1616 corresponding to conventional results when the amplifiers 104 are backed off. This figure shows that the efficiency reduction in this embodiment of the invention is negligible up to an EIRP reduction of about 1.5 dB, over which the amplifiers 104 are saturated. At this EIRP reduction, $C/I_3$ is well above 20 dB.

Figure 18:
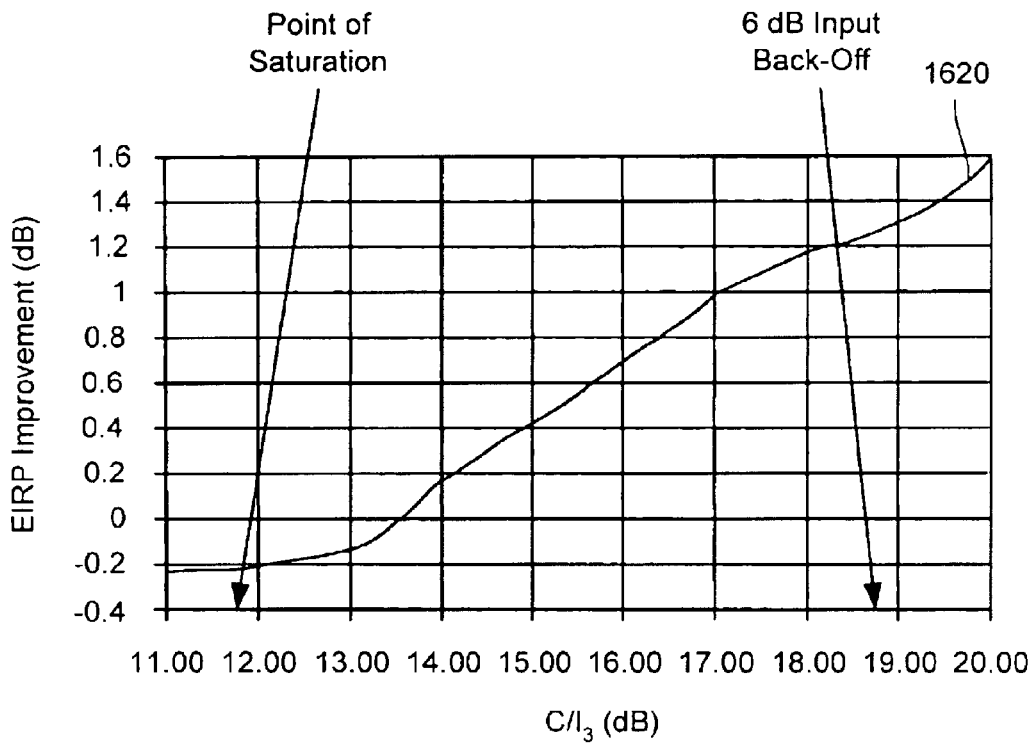
FIG. 18 provides a comparison of EIRP improvement versus $C/I_3$ for an embodiment of the invention using four carriers against a prior-art result.
Figure 19:
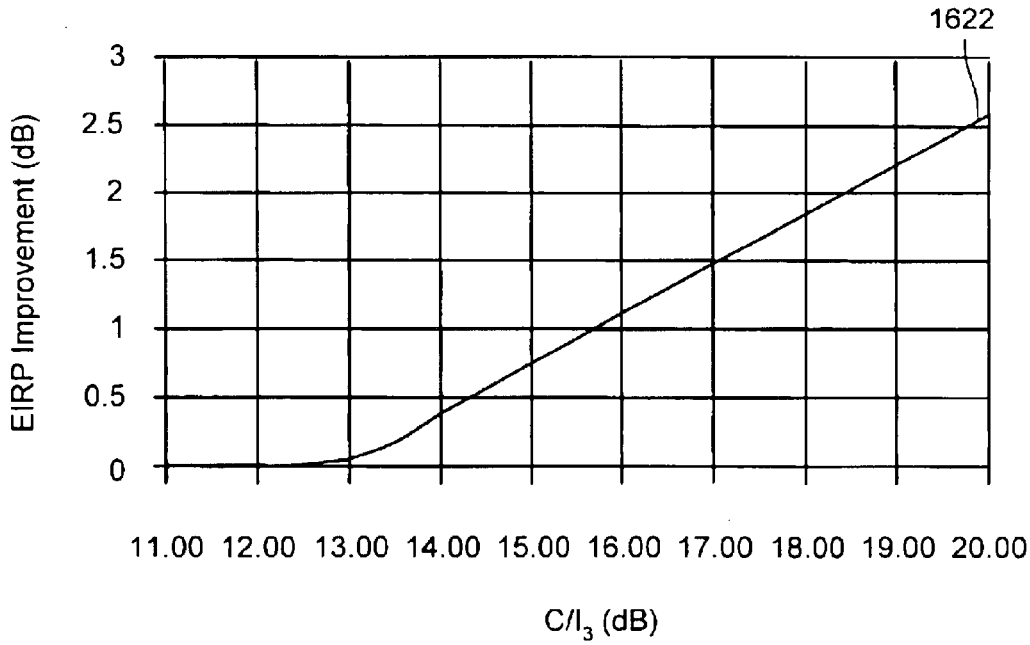
FIG. 19 provides a comparison of efficiency improvement versus $C/I_3$ for an embodiment of the invention using four carriers against a prior-art result.

FIGS. 18 and 19 provide corresponding results for the EIRP improvement and efficiency improvement as a function of $C/I_3$ for this embodiment of the invention over the convention backing off of amplifiers 104. The curve 1620 in FIG. 18 demonstrates a substantial improvement in EIRP for the embodiment of the invention, and curve 1622 in FIG. 19 demonstrates a similarly substantial improvement in efficiency for the embodiment of the invention. Since the worst-case performance has been computed, the EIRP improvement in FIG. 18 includes a 0.27 dB reduction that arises from different minimum EIRP values between the paraboloidal and saddle initial aperture phase distributions. As for the two-carrier results, the efficiency curves in FIGS. 17 and 19 for the four-carrier results reflect averages from a Monte Carlo simulation based on the statistical signal for e(t) as described above. At $C/I_3$ equal to about 18.5 dB, corresponding to a 6-dB back-off in the conventional case, the EIRP is improved by about 1.25 dB and the efficiency is improved by about 2.0 dB.

To summarize, the simulation results illustrate that embodiments of the invention suppress intermodulation patterns and allow the amplifiers 104 to be operated close to saturation for high efficiency. This is achieved without the need for extra hardware on an active phased array antenna since the computed aperture phase distributions may be implemented with existing active phased array antennas. The increased efficiency results in a higher EIRP and reduced amplifier power requirements. This increased EIRP and reduced power requirements are summarized by FIGS. 14 and 15 for two carriers, and by FIGS. 18 and 19 for four carriers. For these embodiments, greater advantages are provided by the invention for more stringent C/I requirements and for four-carrier antennas as compared with two-carrier antennas. One reason for this is that in a conventional approach the amplifiers 104 need to be backed off more in the four-carrier case than in the two-carrier case. Another reason is that the C/I requirement itself may be more stringent in the four-carrier case because of the need for the antenna to accommodate different traffic. Merely by way of example, two illustrations are provided in the following table, which identifies the improvement in those embodiments over conventional active phased array antennas with backed-off amplifiers:

| Case | Two Carriers (dB) | Four Carriers (dB) |
|---|---|---|
| $C/I_3$ Requirement | 16 | 19 |
| EIRP Improvement | 0.8 | 1.3 |
| Power Subsystem Reduction | 0.8 | 2.2 |
| Total DC Power Reduction for Same EIRP | 1.6 | 3.5 |

The table illustrates that the improvement over a conventional active phased array antenna may be exploited in at least two different ways. First, embodiments of the invention may be exploited simultaneously to provide increased EIRP and reduced requirements on the power subsystem. Second, embodiments of the invention may be exploited to use both the EIRP and efficiency improvements to provide a reduced power subsystem for the same specified EIRP as in a conventional active phased array antenna Still other means for using advantages provided by the invention will be evident to those of skill in the art after reading this disclosure.

Having described several embodiments, it will be recognized by those of skill in the art that various modifications, alternative constructions, and equivalents may be used without departing from the spirit of the invention. Accordingly, the above description should not be taken as limiting the scope of the invention, which is defined in the following claims.

What is claimed is:

1. A method for determining aperture phase distributions for use in radiating signals with an active phased array antenna having a plurality of shaped beams and a plurality of carriers, the method comprising:

allocating distinct initial aperture phase distributions corresponding to the plurality of carriers; and optimizing the aperture phase distributions to simultaneously increase carrier-signal power and reduce an intermodulation product radiated in the respective coverage areas in accordance with amplification and radiation of signals having the modified aperture phase distributions.

2. The method recited in claim 1 further comprising modifying the initial aperture phase distributions for each of the plurality of carriers to generate respective radiation patterns that substantially correspond to respective coverage areas in accordance with amplification and radiation of signals having the initial aperture phase distributions.

3. The method recited in claim 1 wherein the respective coverage areas for the plurality of carriers are substantially the same.

4. The method recited in claim 1 wherein at least one of the initial aperture phase distributions is substantially paraboloidal.

5. The method recited in claim 1 wherein at least one of the initial aperture phase distributions is substantially hyperbolically paraboloidal.

6. The method recited in claim 1 wherein a first of the initial aperture phase distributions has two or more orthogonal planes of symmetry about an axis orthogonal to an aperture plane and a second of the initial aperture phase distributions is asymmetric about the axis.

7. The method recited in claim 1 wherein a second of the initial aperture phase distributions is substantially related to a first of the initial aperture phase distributions by complex conjugation and 180° rotation of underlying complex aperture voltage distributions.

8. The method recited in claim 1 wherein the intermodulation product comprises a third-order intermodulation product.

9. The method recited in claim 1 wherein the intermodulation product comprises a fifth-order intermodulation product.

10. The method recited in claim 1 wherein the intermodulation product comprises an in-band intermodulation product.

11. The method recited in claim 1 wherein the active phased array antenna further comprises a second plurality of carriers, the method further comprising:

allocating second initial aperture phase distributions corresponding to the second plurality of carriers, each such second initial aperture phase distribution being substantially equal to one of the initial aperture phase distributions;

modifying the second initial aperture phase distributions for each of the second plurality of carriers to generate respective radiation patterns that substantially correspond to respective coverage areas in accordance with amplification and radiation of signals having the second initial aperture phase distributions; and optimizing the modified second aperture phase distributions to simultaneously increase carrier-signal power and reduce an intermodulation product radiated in the respective coverage areas in accordance with amplification and radiation of signals with the modified aperture phase distributions and second modified aperture phase distributions.

12. The method recited in claim 11 wherein each of the plurality of carriers and the second plurality of carriers is less than five in number.

13. A method for radiating a plurality of shaped beams with an active phased array antenna having a plurality of carriers, wherein the beams have aperture phase distributions determined with the method recited in claim 1.

14. A method for radiating a plurality of shaped beams with an active phased array antenna having a plurality of carriers, the method comprising:

radiating a first of the plurality of shaped beams with a first of the plurality of carriers; and radiating a second of the plurality of shaped beams with a second of the plurality of carriers, wherein the plurality of shaped beams have aperture phase distributions determined in accordance with the following:

allocating distinct initial aperture phase distributions corresponding to the plurality of carriers;

modifying the initial aperture phase distributions for each of the plurality of carriers to generate respective radiation patterns that substantially correspond to respective coverage areas in accordance with amplification and radiation of signals having the initial aperture phase distributions; and optimizing the modified aperture phase distributions to simultaneously increase carrier-signal power and reduce an intermodulation product radiated in the respective coverage areas in accordance with amplification and radiation of signals having the modified aperture phase distributions.

15. The method recited in claim 14 wherein the respective coverage areas for the plurality of carriers are substantially the same.

16. The method recited in claim 14 wherein at least one of the initial aperture phase distributions is substantially paraboloidal.

17. The method recited in claim 14 wherein at least one of the initial aperture phase distributions is substantially hyperbolically paraboloidal.

18. The method recited in claim 14 wherein a first of the initial aperture phase distributions is rotationally symmetric about an axis orthogonal to an aperture plane and a second of the initial aperture phase distributions is asymmetric about an axis orthogonal to the aperture plane.

19. The method recited in claim 14 wherein a second of the initial aperture phase distributions is substantially related to a first of the initial aperture phase distributions by complex conjugation and 180° rotation of underlying complex aperture voltage distributions.

20. The method recited in claim 14 wherein the intermodulation product comprises a third-order intermodulation product.

21. The method recited in claim 14 wherein the intermodulation product comprises a fifth-order intermodulation product.

22. The method recited in claim 14 wherein the intermodulation product comprises an in-band intermodulation product.

23. The method recited in claim 14 wherein the active phased array antenna further comprises a second plurality of carriers, the method further comprising:

radiating a third of the plurality of shaped beams with a first of the second plurality of carriers;

radiating a fourth of the plurality of shaped beams with a second of the second plurality of carriers, wherein the plurality of shaped beams have aperture phase distributions further determined in accordance with the following:

allocating second initial aperture phase distributions corresponding to the second plurality of carriers, each such second initial aperture phase distribution being substantially equal to one of the initial aperture phase distributions;

modifying the second initial aperture phase distributions for each of the second plurality of carriers to generate respective radiation patterns that substantially correspond to respective coverage areas in accordance with amplification and radiation of signals having the second initial aperture phase distributions; and optimizing the modified second aperture phase distributions to simultaneously increase carrier-signal power and reduce an intermodulation product radiated in the respective coverage areas in accordance with amplification and radiation of signals with the modified aperture phase distributions and second modified aperture phase distributions.

24. The method recited in claim 23 wherein each of the plurality of carriers and the second plurality of carriers is less than five in number.

25. An active phased array antenna comprising:

a plurality of antenna elements;

a plurality of filter elements coupled with the antenna elements;

a plurality of amplifier elements coupled with the filter elements;

a plurality of beam ports; and a beamformer having a plurality of elemental paths for coupling the beam ports with the amplifier elements, wherein the beamformer includes phase shifters adapted to provide aperture phase distributions per beam to the amplifier elements in accordance with the following:

allocating distinct initial aperture phase distributions corresponding to the plurality of amplifier elements; and optimizing the aperture phase distributions to simultaneously increase carrier-signal power and reduce an intermodulation product radiated in the respective coverage areas in accordance with amplification and radiation of signals having the modified aperture phase distributions with the amplifier elements and antenna elements.

26. The active phased array antenna recited in claim 25 wherein the beamformer is further adapted to modify the initial aperture phase distributions for each of the plurality of amplifier elements to generate respective radiation patterns that substantially correspond to respective coverage areas in accordance with amplification and radiation of signals having the initial aperture phase distributions with the amplifier elements and antenna elements.

27. The active phased array antenna recited in claim 25 wherein the respective coverage areas for the plurality of carriers are substantially the same.

28. The active phased array antenna recited in claim 25 wherein at least one of the initial aperture phase distributions is substantially paraboloidal.

29. The active phased array antenna recited in claim 25 wherein at least one of the initial aperture phase distributions is substantially hyperbolically paraboloidal.

30. The active phased array antenna recited in claim 25 wherein a first of the initial aperture phase distributions is rotationally symmetric about an axis orthogonal to an aperture plane and a second of the initial aperture phase distributions is asymmetric about an axis orthogonal to the aperture plane.

31. The active phased array antenna recited in claim 25 wherein a second of the initial aperture phase distributions is substantially related to a first of the initial aperture phase distributions by complex conjugation and 180° rotation of underlying complex aperture voltage distributions.

32. The active phased array antenna recited in claim 25 wherein the intermodulation product comprises a third-order intermodulation product.

33. The active phased array antenna recited in claim 25 wherein the intermodulation product comprises a fifth-order intermodulation product.

34. The active phased array antenna recited in claim 25 wherein the intermodulation product comprises an in-band intermodulation product.

35. The active phased array antenna recited in claim 25 wherein the phase shifters are further adapted to provide aperture phase distributions to the amplifier elements in accordance with the following:

allocating second initial aperture phase distributions corresponding to the second plurality of amplifier elements, each such second initial aperture phase distribution being substantially equal to one of the initial aperture phase distributions;

modifying the second initial aperture phase distributions for each of the second plurality of amplifier elements to generate respective radiation patterns that substantially correspond to respective coverage areas in accordance with amplification and radiation of signals having the second initial aperture phase distributions with the amplifier elements and antenna elements; and optimizing the modified second aperture phase distributions to simultaneously increase carrier-signal power and reduce an intermodulation product radiated in the respective coverage areas in accordance with amplification and radiation of signals having the modified aperture phase distributions and second modified aperture phase distributions with the amplifier elements and antenna elements.

* * * * *